US007594502B1

(12) United States Patent
Anderson

(10) Patent No.: US 7,594,502 B1
(45) Date of Patent: Sep. 29, 2009

(54) PROJECTILE LOADING, FIRING AND WARNING SYSTEM

(76) Inventor: Joel A. Anderson, 9921 Toledo Dr. North, Brooklyn Park, Hennepin, MN (US) 55443

( * ) Notice: Subject to any disclaimer, the term of this patent is extended or adjusted under 35 U.S.C. 154(b) by 240 days.

(21) Appl. No.: 11/608,227

(22) Filed: Dec. 7, 2006

Related U.S. Application Data

(60) Provisional application No. 60/748,552, filed on Dec. 7, 2005, provisional application No. 60/864,785, filed on Nov. 7, 2006.

(51) Int. Cl.
*F41B 11/00* (2006.01)

(52) U.S. Cl. ..... 124/71; 124/72; 124/77

(58) Field of Classification Search ..... None
See application file for complete search history.

(56) References Cited

U.S. PATENT DOCUMENTS 3,640,263 A 2/1972 Rhodes
3,822,724 A 7/1974 Clapp et al.
4,223,592 A 9/1980 Fischer et al.
4,269,163 A * 5/1981 Feith ..... 124/77
4,340,083 A 7/1982 Cummins
4,424,825 A 1/1984 Hanson
4,545,561 A 10/1985 Brown
4,561,627 A 12/1985 Meckstroth
4,567,394 A 1/1986 Frisch
4,770,153 A 9/1988 Edelman
5,079,472 A 1/1992 Uhl et al.
5,094,429 A 3/1992 Dostert
5,097,816 A 3/1992 Miller
5,114,116 A 5/1992 Muller et al.
5,282,454 A 2/1994 Bell et al.
5,447,286 A 9/1995 Kamen et al.
5,505,188 A 4/1996 Williams
5,511,333 A 4/1996 Farrell
5,646,909 A 7/1997 Bouyoucos
5,646,910 A 7/1997 Bouyoucos
5,727,538 A * 3/1998 Ellis ..... 124/77
5,779,218 A 7/1998 Kowanz
5,791,325 A 8/1998 Anderson
5,924,413 A 7/1999 Johnson et al.
5,947,100 A 9/1999 Anderson
5,954,030 A 9/1999 Sturman et al.
5,954,042 A 9/1999 Harvey
6,065,688 A 5/2000 Wilson et al.
6,076,555 A 6/2000 Hettinger
6,109,252 A 8/2000 Stevens
6,142,137 A 11/2000 Maclaughlin
6,152,125 A 11/2000 Piper
6,213,110 B1 4/2001 Christopher et al.
6,267,146 B1 7/2001 Miyazoe et al.
6,293,308 B1 9/2001 Hettinger (Continued)

*Primary Examiner*—Michael Carone
*Assistant Examiner*—Samir Abdosh
(74) *Attorney, Agent, or Firm*—Albert W. Watkins

(57) ABSTRACT

Methods are presented which improve the performance of semi and fully automatic paintball guns include sensing paintball and gun bolt position during loading to coordinate and pace the gun for maximum automatic feed rate and minimal chopping. In addition, methods are presented for indicating a need for servicing through an alarm when the magazine nears empty based upon various conditions such as sensed magazine feed rate fall-off. Additional apparatus are discussed for carrying out the methods, and for performance of other tasks such as selection of pre-wind in spring-type forced-feed loaders.

10 Claims, 12 Drawing Sheets

U.S. PATENT DOCUMENTS

| | | | | |
|---|---|---|---|---|
| 6,302,092 | B1 | 10/2001 | Juan | |
| 6,305,367 | B1 | 10/2001 | Kotsiopoulos et al. | |
| 6,311,682 | B1 | 11/2001 | Rice et al. | |
| 6,327,953 | B1 | 12/2001 | Andresen | |
| 6,467,473 | B1 | 10/2002 | Kostiopoulos | |
| 6,488,019 | B2 | 12/2002 | Kotsiopoulos | |
| 6,502,567 | B1 | 1/2003 | Christopher et al. | |
| 6,601,780 | B1 | 8/2003 | Sheng | |
| 6,615,814 | B1 * | 9/2003 | Rice et al. | 124/71 |
| 6,644,296 | B2 | 11/2003 | Gardner, Jr. | |
| 6,684,873 | B1 | 2/2004 | Anderson et al. | |
| 6,701,907 | B2 | 3/2004 | Christopher et al. | |
| 6,763,822 | B1 | 7/2004 | Styles | |
| 6,792,933 | B2 | 9/2004 | Christopher et al. | |
| 6,857,422 | B2 | 2/2005 | Pedicini et al. | |
| 6,860,259 | B2 | 3/2005 | Rice et al. | |
| 6,871,833 | B1 | 3/2005 | Zeh et al. | |
| 6,889,680 | B2 | 5/2005 | Christopher et al. | |
| 6,928,999 | B1 | 8/2005 | Hslao et al. | |
| 6,948,487 | B2 * | 9/2005 | Rice et al. | 124/32 |
| 6,966,313 | B1 * | 11/2005 | Yokota et al. | 124/32 |
| 7,017,569 | B2 | 3/2006 | Jong | |
| 2002/0020402 | A1 | 2/2002 | Kostiopoulos | |
| 2002/0170552 | A1 | 11/2002 | Gardner, Jr. | |
| 2003/0010330 | A1 | 1/2003 | Jong | |
| 2003/0226555 | A1 | 12/2003 | Reible | |
| 2004/0055588 | A1 * | 3/2004 | Rice et al. | 124/71 |
| 2004/0074487 | A1 | 4/2004 | Christopher et al. | |
| 2004/0134475 | A1 | 7/2004 | Jong | |
| 2005/0188975 | A1 * | 9/2005 | Rice et al. | 124/71 |
| 2005/0217653 | A1 | 10/2005 | Christopher et al. | |
| 2006/0054151 | A1 | 3/2006 | Christopher et al. | |
| 2006/0130822 | A1 | 6/2006 | Jong | |
| 2007/0062509 | A1 * | 3/2007 | Campo et al. | 124/73 |
| 2007/0209650 | A1 * | 9/2007 | Jones | 124/73 |
| 2007/0215135 | A1 * | 9/2007 | Campo | 124/77 |

* cited by examiner

FIG. 4
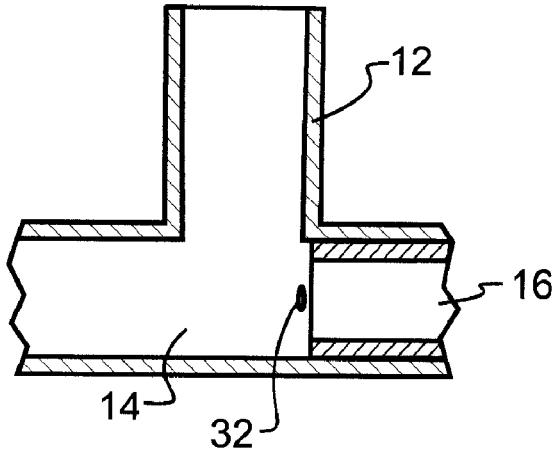
FIG. 5
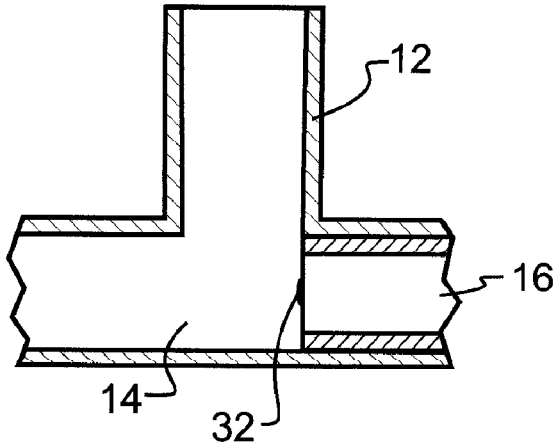
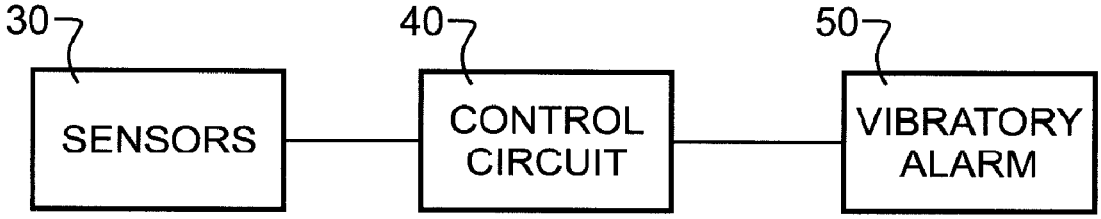
FIG. 6

(PRIOR ART) FIG. 26

(PRIOR ART) FIG. 27

PROJECTILE LOADING, FIRING AND WARNING SYSTEM

CROSS REFERENCE TO RELATED APPLICATIONS

This application claims priority to U.S. provisional patent application 60/748,552 filed Dec. 7, 2005 and also to U.S. provisional patent application 60/864,785 filed Nov. 7, 2006, each naming the present inventor.

BACKGROUND OF THE INVENTION

1. Field of the Invention

This invention pertains generally to mechanical guns and projectors, and more specifically to fluid pressure devices. The present invention in one manifestation pertains to an electronically controlled paint ball delivery and firing system that may be operated reliably at enormous firing rates, and which provides early warning of impending need for service.

2. Description of the Related Art

For the purposes of this disclosure, paint ball guns are specifically defined as apparatus that propel gelatin or other frangible capsules filled with paint or dye from a barrel in rapid succession and at relatively high speeds. The paint ball capsules are designed to break upon impact with an object or person, most preferably without injuring the person or object. The ball impact expels the paint or dye, rendering an identifiable mark. Because of the relative safety of the marker, and the entertainment that is intrinsic, modern paint ball guns are used quite extensively for both recreational and training purposes.

Paint ball guns can fire in rapid succession a relatively large number of paint balls in a short period of time. A magazine stores the necessary supply of paint balls until the balls are delivered sequentially to the gun firing chamber. The guns most commonly use compressed gas as the propellant, and are usually triggered by a user squeezing a gun trigger. When the gun user repeatedly squeezes the trigger, the gun should continue to fire paint balls as rapidly as possible. Guns may be manually loaded before each shot, but most are either semi-automatic, where each time the trigger is pulled a paint ball is fired, or fully automatic, where the balls are fired as quickly as the gun is capable for as long as the trigger is pulled.

Quite unlike conventional explosive-propelled munitions, paint balls are relatively round and have an exterior formed from a semi-rigid gelatinous compound. The gelatinous compound is known to be affected somewhat by such variables as temperature and relative humidity, and is of course somewhat frangible. During a firing sequence, paint balls on occasion lodge against each other or other objects and block the passageway to the firing chamber, resulting in a jam. While jamming is not new, knowledge from explosive munitions magazines is of little use with the very different paint balls.

Basic paint ball magazines are little more than large hoppers with a feed tube extending therefrom, a sort of closed funnel through which paint balls are dropped into the firing chamber. Unfortunately, the passageway must ultimately taper to isolate single paint balls therein. Usually this is not a gradual taper, but a sudden transition, to reduce the likelihood of two balls getting stuck against each other. Unfortunately, when one paint ball does lodge against the other or against another object, the user must shake the gun to free the balls. Paint balls passing through a typical basic magazine do so by virtue of gravitational forces alone. In a typical basic magazine, gravity supplied balls require approximately 50 milliseconds per ball to be loaded into the breech for firing, presuming there are no other interruptions such as blocked passages, or frictional interference between balls, or any tilting of the gun. So, in an ideal circumstance, the basic magazine could be used to supply up to 20 balls per second (50 ms/ball×20 balls=1 second). Unfortunately, with only gravity feed and without the addition of an agitator, the frictional interference, intermittent jamming and bolt cycle time reduce this feed rate by almost a full order of magnitude from the theoretical maximum when the gun is held vertically. Moreover, the feed rate may potentially drop to zero balls per second if the gun is tilted during use or when the balls do not feed in an orderly fashion.

One method of preventing paint ball jams is proposed by Miller in U.S. Pat. No. 5,097,816. Therein, a large helical magazine is provided through which the paint balls pass in a single row, eventually leading to the firing chamber. Farrell in U.S. Pat. No. 5,511,333 also illustrates a magazine designed not to jam, using a straight tube design. U.S. Pat. No. 5,282,454 to Bell et al discloses a large magazine having a generally open interior with sloping ends and side walls that lead downward to a tubular passageway referred to as a feed tube. Gravitational forces tend to urge the paint balls to the feed tube, and an agitator paddle is provided to stir the paint balls. However, once the balls have passed through the opening into the feed tube, they are still operating under gravitational influences, and so in the best of circumstances, will still be limited to feed rates approximating 20 balls per second. Frictional interference, bolt cycle time and more empty magazines reduce this number, and in practice the actual feed rate is still typically less than one-half of the theoretical rate.

Williams, in U.S. Pat. No. 5,505,188, discloses a coiled tube within the magazine chamber that is pressurized during the firing process to force balls into the feed tube. During rapid fire sequences, the magazine is agitated by motion of the coiled tube. Harvey in U.S. Pat. No. 5,954,042 illustrates a loader that moves peripherally located balls within a magazine, and expels them centrifugally into a feed tube. Stevens, in U.S. Pat. No. 6,109,252, discloses another paint ball carrier which receives paint balls in pockets around the periphery thereof. A guide assembly improves the orderly feeding of balls into an opening. Andresen in U.S. Pat. No. 6,327,953 discloses another circumferential disk loader. Jong, in U.S. published application 2004/0134475, 2006/0130822 and U.S. Pat. No. 7,017,569 discloses another force-feeding system. Kostiopoulos in U.S. Pat. Nos. 6,305,367; 6,467,473 and 6,488,019 illustrates another type of peripheral loader. Finally, a number of patents and published applications by James Christopher et al illustrate additional circumferential force feeding systems, including U.S. Pat. Nos. 6,213,110; 6,502,567; 6,701,907; 6,792,933; 6,889,680 and 2006/0054151. Feeders which utilize the Stevens, Christopher or Jong apparatuses, or other force-fed devices, may be designed to substantially exceed the standard gravity feed rate. Exemplary feeders are often able to feed balls into the breech at 20 millisecond intervals, or at a rate of approximately 50 balls each second. Nevertheless, these feeders couple through some type of feed tube to the breech. When the supply of balls in the magazine dwindles or is exhausted, the rate of feed will diminish from the 20 millisecond intervals to the 50, 100 or more milliseconds required by the gravity-fed magazines. Furthermore, where spring mechanisms are used, such as with Jong, Andresen, and Christopher, the spring force will vary as the magazine empties, thereby also changing and slowing the feed rate.

Anderson, the present inventor, in U.S. Pat. Nos. 5,791,325; 5,947,100; and 6,684,873, discloses a paint ball gun including an improved agitator which delivers higher paint ball feed rates than other prior art gravity-fed agitators; an electronic circuit having a duration control which delays turning off the motor for a predetermined interval while activating the motor continuously during a rapid firing sequence; a magnetic, sound, pressure, shock or similar sensor to trigger the electronic circuit into energizing the motor; and a tilt sensor to selectively control direction of a paint ball gun magazine agitator motor, which in response to the magazine being tilted generates an electrical direction indicator signal, a tilt duration detector timing the electrical direction indicator signal, and an electrical circuit for controlling a direction of rotation of the paint ball magazine agitator motor responsive thereto. Each of these improve upon the prior art feeders, but, like all feeders, are prone to instances where feed may be interrupted or slowed.

A number of artisans have also designed systems which monitor various operations within a paint ball gun. Nearly every modern gun has a sensor in the breech region to detect the presence of a paint ball, and to prevent firing without a ball present. U.S. published patent application 2002/0020402 by Kotsiopoulos, entitled "Feeder for a Paintball Gun," describes a paintball feeder that may be interconnected with the firing control of the paintball gun. Sensors are used to prevent accidental breakage of paintballs which are misfed (e.g., incompletely fed) to the paintball gun's infeed. The determination which is made is one of whether the paint ball is present or absent in a region monitored by a sensor. U.S. published patent application 2002/0170552 and the resulting U.S. Pat. No. 6,644,296 by Gardner Jr., entitled "Dynamic Paintball Gun Control," describes the use of a loading sensor to identify loading problems and dynamically adjust solenoid valve dwell settings, agitator settings on the loader, or other settings to improve loading characteristics. Other sensors are also proposed, including sensors to measure paintball velocity, temperature, chamber pressure, acoustic report, and valve characteristics. Nevertheless, there is no discussion of how such adjustments and settings might be made, nor how such a system could then be optimally operated. U.S. Pat. No. 6,142,137 by MacLaughlin, entitled "Trigger Control System for a Paint Ball Gun," describes a paintball gun including a sensor incorporated into the electronic circuitry to ascertain when a paint ball is properly seated within the firing chamber, to in turn permit firing. Once again, this system detects a presence or absence of the paintball. U.S. Pat. No. 5,727,538 by Ellis, entitled "Electronically Actuated Marking Pellet Projector", describes a paintball gun with several sensors for positions of gun elements, including a projectile sensor which must sense the presence of a paintball prior to sending the bolt forward. Additional sensors may be also sense the bolt position. U.S. published patent application 2003/0226555 by Reible, entitled "Pneumatic Projectile Launching Apparatus with Partition-Loading Apparatus", describes a feed system that uses sensors to determine conditions of the process such as projectile loading status or partition location and adjust the cycle rate to those conditions. Much like Gardner though, there is no discussion in the Reible application of how such adjustments and settings might be made, nor how such a system could then be optimally operated. Finally, U.S. published patent application 2004/0134475 by Jong, entitled "Paintball Marker Loader Apparatus" and also referenced herein above, describes the use of multiple sensors along the length of the passageway of the delivery conduit of the magazine of a paintball gun. A separate controller is provided to control magazine operation.

Each of the aforementioned patents and published applications are incorporated herein by reference, for their various teachings including but not limited to the various magazine technologies and associated sensor and control systems.

As paintball guns continue to be refined, firing rates continue to increase. Improved firing rates allow a participant to fan an area or still be moving the gun during firing, while standing a much greater chance of striking an opponent located somewhere within the arc of shots fired with at least one paintball. Said another way, the angular spread between individual paintballs decreases, in turn decreasing the physical space between balls at some radius or distance from the firing gun. Rapid firing then requires less precision in aiming, in turn allowing a participant to be moving and not requiring time to line up a shot, which is advantageous during a competition. Furthermore, and unlike the munitions counterparts of modern weapons, paintballs do not have the highly refined directional control that is obtained form precise fabrication and projectile direction enhancement such as the spiraling or fluting that may be found on modern explosively propelled projectiles. As a result, the shot spread is much greater for paintballs than for bullets. Because of this, and at any distance other than close ranges, a shooter will typically require more shots to mark a target than would be required with bullets. Consequently, any techniques which can improve the peak firing rate of a gun offer advantage in a competition, so long as other factors, such as maintaining an adequate supply of paintballs, are not sacrificed.

In addition to feed rate, other factors are important and beneficial. For example, when a magazine is operating, there is little if any indication of impending need for service. When a magazine jams, the gun will no longer fire due to the breech sensor. However, the participant only learns of this after there is no shot emanating from the gun. If this were, for example, to occur when the gun operator was moving in an exposed area and trying to cover himself through a rapid firing succession, the operator would be much more exposed than anticipated. Many of the aforementioned magazines, when they run low, will also reduce the firing rate of a gun. Once again, until the magazine is empty, there is no warning or indication for the operator that the gun will no longer fire at the same firing rates as are otherwise typical. Such unexpected events may leave the gun operator at a particular disadvantage. There has been no compensation heretofore provided within the gun for the decreased feed rates, which might otherwise to some extent mitigate the disadvantages to the operator. Some proposals come from the aforementioned patents to Jong, which discuss as an alternative embodiment that one or more of the indicators indicate a condition using a vibrator device that could be activated to notify the user that a low-balls condition or a low battery condition exists. There is no discussion of how this would be implemented, or of any way to mitigate the reduced load speed.

Another important issue, particularly when using many of the modern force-feed systems at high firing rates, is a likelihood of chopping not the paintball within the breech, but instead the second ball. This chopping occurs due to undesirable compression of the entire stack of balls within the feed stack. These balls are compressed more greatly by force feed systems, and again when spring systems are used and these springs are wound for maximum force.

Each of these aforementioned issues, and others that arise directly therefrom, leave opportunity for improvement and advancement in the paintball industry. It is these deficiencies and limitations that the present invention addresses.

SUMMARY OF THE INVENTION

In a first manifestation, the invention is a method of anticipatory operation of a magazine loader motor in a paint ball gun having a bolt and a breech, to avoid undesirable paint ball chopping and breakage. According to the method, a signal representative of a power consumption of the magazine loader motor is measured. A gun bolt position is detected. The position of a paintball relative to a ready-to-fire position within a gun breech is monitored and communicated to a feed motor power consumption control circuit. Responsive to the gun bolt position and paint ball position relative to ready-to-fire position, power consumption of the feed motor is altered to increase power consumption prior to the gun bolt opening access of the paint ball to breech, and to reduce power consumption in advance of the paint ball position reaching ready-to-fire position within the breech.

In a second manifestation, the invention is a method for warning a paint ball gun operator of a need for impending service in a paint ball gun having a breech, a loader and loader motor. According to the method, a rate of ingress of paint balls into a breech in the paint ball gun is measured. An electrical signal indicative of a current flowing through a loader motor is monitored. An historical record indicative of proper loader operation is developed responsive to the monitoring and measuring. The historical record is compared with the rate of ingress and the electrical signal indicative of a current, to develop a status result. The operator is warned when the status result is indicative of improper operation.

In a third manifestation, the invention is a method of anticipatory operation of a bolt in an electro-pneumatic paint ball gun to improve a firing rate of the gun. According to the method, a rate of ingress of paint balls into a breech in the paint ball gun is measured. A first electrical activation to initiate bolt motion is monitored for. A time required to move the bolt is measured from the time of first electrical activation. The bolt is triggered through first electrical activation prior to a paint ball being in a firing position in the breech by an amount of time no greater than the bolt moving time.

OBJECTS OF THE INVENTION

Exemplary embodiments of the present invention solve inadequacies of the prior art by providing a fully automatic paintball gun action that senses paintball and gun bolt position during loading to coordinate and pace the gun for maximum automatic feed rate. An alarm, vibratory or otherwise, alerts the user when the magazine nears empty, based upon the sensed magazine feed rate fall-off. In a most preferred embodiment, the sensing may occur not only in the breech but also through motor current sensing. When the feed stack is positioned for the next firing, or in immediate anticipation thereof, the motor may be reversed to reduce the force upon the feed stack, thereby reducing the likelihood of chopping the second ball in the stack.

A first object of the invention is to enable a marker gun to operate at the minimum mechanical cycle time, for a maximum rate of firing. A second object of the invention is to automatically adjust the cycle time for changes detected therewith that will occur in real time, such as but not limited to variations in spring force or magazine fill levels, so that the gun is not only capable of high burst rates, but also reliable firing at sustained high rates. Another object of the present invention is to provide anticipatory notice to an operator of an impending need for servicing. A further object of the invention is to control the force within a feed stack to reduce chopping, while still ensuring that the stack is positively held in a ready state. An additional object of the invention is to control forces applied to the paintballs such that the balls are not only moved quickly, but also more gently than in prior art force-feed loaders. Yet another object of the present invention is to enable a marker gun using any one of a wide variety of loaders to achieve the foregoing objectives.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which:

FIG. 4 illustrates a first alternative embodiment sensor arrangement in a ready-to-fire position for use with a first alternative embodiment method, but with the breech empty, from an enlarged cross-sectional view.

FIG. 5 illustrates the first alternative embodiment sensor arrangement of FIG. 4 during firing, with the bolt located in a position which would ordinarily be just prior to contact with a paintball within the breech, from an enlarged cross-sectional view, and without a paintball in the breech.

FIG. 6 illustrates the preferred embodiment circuitry from a simplified block diagram.

FIGS. 26-27 illustrate a prior art loader, while

DESCRIPTION OF THE PREFERRED EMBODIMENT

The present invention, as manifested in the preferred and alternative embodiments illustrated herein, offers a number of benefits over the prior art, including increased firing rates, gentler ball handling, mitigation of undesirable delays in firing during periods of lower feed rates into the breech, and anticipation of need for service or reload of a magazine or other feeder.

Figure 1:
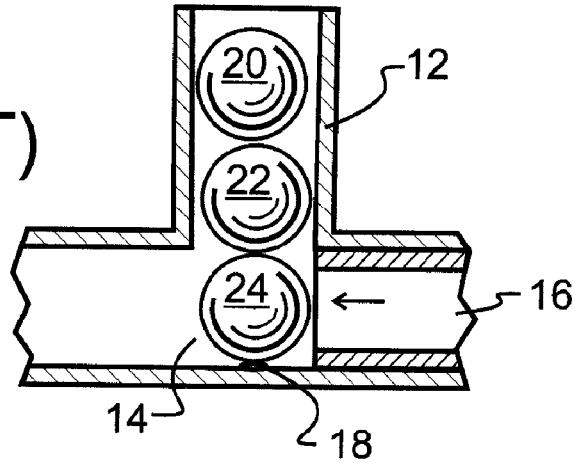
FIG. 1 (PRIOR ART)
FIG. 1 illustrates a prior art firing chamber, including bolt, feed tube, breech, breech sensor and paintballs in a ready-to-fire position, from an enlarged cross-sectional view.
Figure 2:
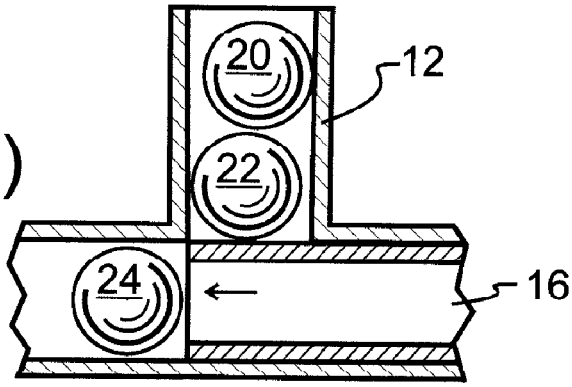
FIG. 2 (PRIOR ART)
FIG. 2 illustrates the prior art firing chamber of FIG. 1 during firing, with the bolt moved forward towards the gun exit and covering the breech sensor, from an enlarged cross-sectional view.
Figure 3:
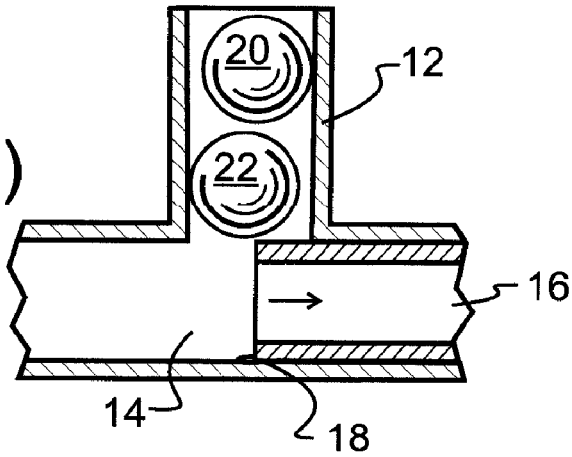
FIG. 3 (PRIOR ART)
FIG. 3 illustrates the prior art firing chamber of FIG. 1 during firing, with the bolt returning back from the gun exit and opening the breech sensor, from an enlarged cross-sectional view.

FIG. 1 illustrates a typical prior art firing chamber, including bolt 16, feed tube 12, breech 14, breech sensor 18 and paintballs 20-22 in a ready-to-fire position. In this position, breech sensor 18 detects the presence of an obstacle blocking the sensor beam. Since the gun is not in the firing cycle, the obstacle is interpreted as being a paintball 24 in a ready-to-fire position. FIG. 2 illustrates bolt 16 after firing has been initiated, such as by a trigger pull, with bolt 16 moved forward towards the gun exit and covering breech sensor 18, from an enlarged cross-sectional view. Depending upon the design of the 16, ball 24, and placement of sensor 18 and the like, sensor 18 may or may not briefly signal an open breech 14 as bolt 16 moves forward. Next, as FIG. 3 illustrates, bolt 16 will be returning back from the gun exit as paintball 24 is being propelled from the gun barrel. This return movement will allow breech sensor 18 to detect an open breech 14, until bolt 16 passes far enough back to permit the next ball 22 to be loaded from feed tube 12 inlet into breech 14.

A number of useful timing signals, which are not presently being utilized in the operation of paintball guns but which may be obtained from this simple prior art operation using a single ball sensor 18 of the prior art, may be derived to the benefit of the gun and operator. A first measurable component, for guns where there is a brief open-breech signal after triggering and while bolt 16 is moving forward, provides a rough measure of the time that it takes to activate and move bolt 16 forward after the trigger is pulled. A limiting factor for most paintball guns is the time from when a ball 24 falls into place into breech 14 and the time it takes bolt 16 to start moving. There is a lag time between the lightning fast micro controllers and the time it takes to energize the coil of the solenoid that will in turn open a pneumatic valve. There is another time lag between the time the solenoid is engaged and the time is takes to generate enough pneumatic pressure to get bolt 16 to move. The total time lag may typically be in the range of 5 milliseconds to 20 milliseconds. Saving 5 milliseconds could enable a gun firing 18 balls per second (bps) to fire about 20 bps.

Where desirable or necessary, another sensor 32 on bolt 16 as illustrated in FIGS. 4 and 5 can help reduce wasted time by knowing the exact time it takes for bolt 16 to start moving after the start of the energizing the solenoid. As aforementioned, additional bolt timing information may be gained in some guns by breech sensor 18, determining the time it takes bolt 16 to move one-half the distance forward after energizing the solenoid.

Assume it takes 15 milliseconds to get bolt 16 to start moving. Assume 20 milliseconds for a ball to fall from feed tube 12 into the ready-to-fire position shown in FIG. 1. In this case the solenoid can be started 5 milliseconds after the ball begins descending into breech 14. 15 milliseconds later, the ball will reach final position at the same time bolt 16 will start to move forward. This takes out all wasted time in the cycle. If for some reason 15 milliseconds later breech sensor 18 is not triggered, indicating that the ball did not load in at expected speed, the solenoid can be turned off and the shot aborted.

The exact time it takes for bolt 16 to start moving after the start of energizing the solenoid can be measured by a microcontroller illustrated as the control circuit in FIG. 6, and used in the firing sequence. An optical sensor 32 is placed close to bolt 16 as shown in FIGS. 4 and 5. This measurement could be done with a test shot without a paintball in breech 14. Alternatively, another type of sensor other than optical, such as a proximity or magnetic sensor, could be used to detect position and then the time lag could be monitored shot by shot. If aborting a shot is needed, it is important to know the maximum time the solenoid can be powered before bolt 16 moves. In order to abort the shot, the solenoid cannot be powered for longer than this time.

An automatic calibration sequence can be applied where the solenoid is energized for 1 millisecond and sensor 32 is scanned for proof of bolt movement. If no movement is detected, then the solenoid is re-energized for 2 milliseconds and bolt 16 is checked for movement. This energizing and checking, with increasing time intervals, is then repeated until bolt movement is detected. The maximum time the solenoid may be powered before aborting would be the longest time used that did not result in a bolt movement.

A second measurable timing signal is the amount of time required for a ball to be loaded into breech 14. As described herein above, when most force-feed loaders are nearly empty, the average time required to load ball 24 from feed tube 12 to breech 14 increases significantly. As conceived herein, the state of the magazine may be monitored directly from within the magazine. Conceived herein are sensors located directly within the magazine that measure parameters therein, such as the relative content of the magazine which may be readily measured by a sensor detecting the location of pressure plate 38 in the Jong application discussed herein above.

Another sensor conceived herein, and suitable for use with the Bell and Anderson agitators described herein above and other both force and gravity feed systems, senses the current passing through the agitator or hopper motor. As the magazine empties, the motor draws less current, indicating an impending need to reload the magazine. In the event of a jam, the motor draws more current. In summary, either the advancement of the pressure plate in the Jong apparatus or the variation in load on the Bell and Anderson agitators can then be monitored. In turn, and as FIG. 6 illustrates, this change in state that is monitored and sensed through the sensors will be passed to a control circuit for threshold detection. When the sensor signals a sufficient need, a vibratory alarm will preferably be triggered which will signal to the gun operator the need to refill paintballs, prior to detrimental gun operations. One technique for monitoring the motor current is to measure the voltage at the battery just prior to initiating the hopper motor, and then at later times to detect the current-based voltage drop across the internal impedance of the battery.

Figure 13:
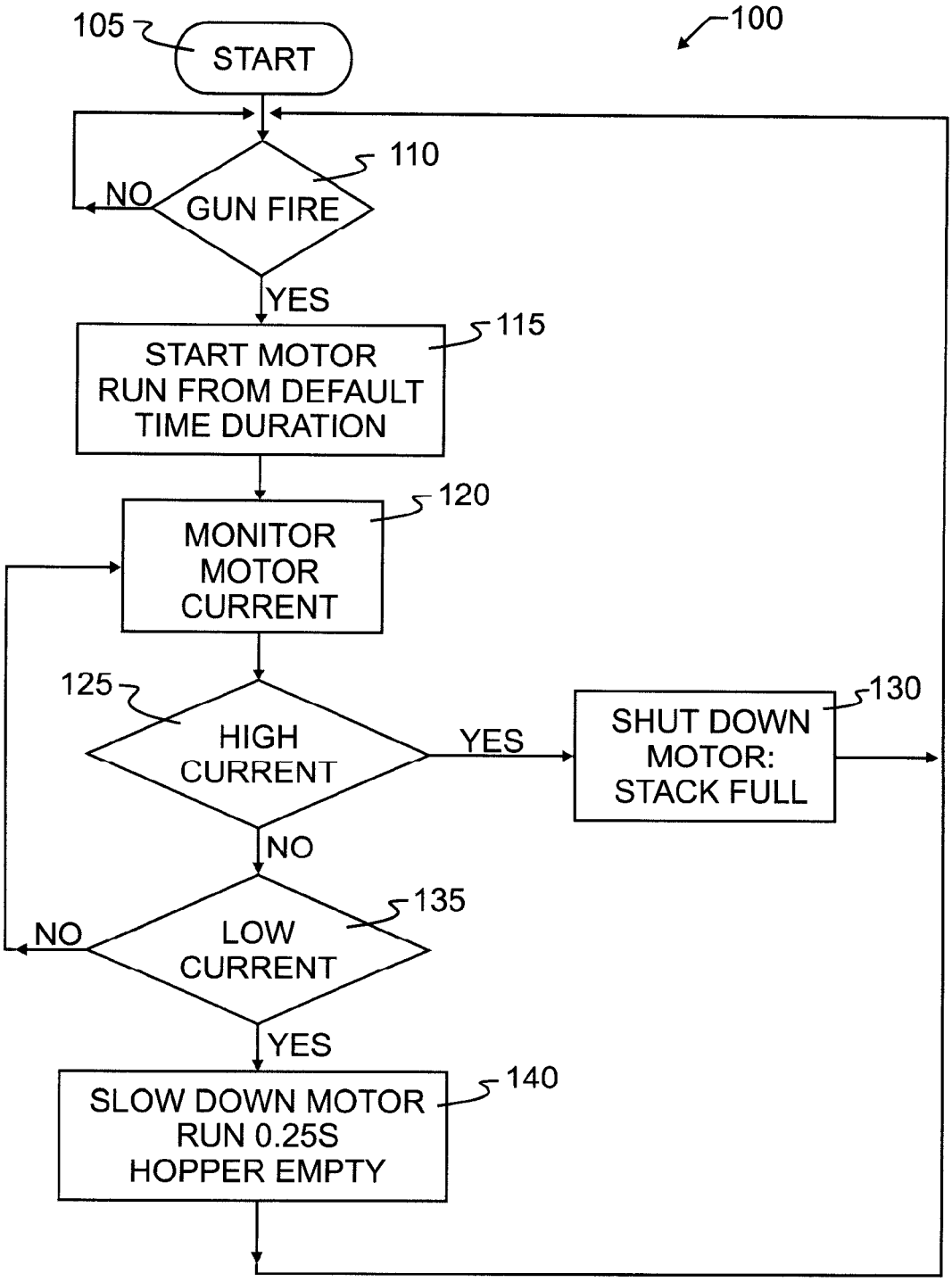
FIGS. 13-15 illustrate by flow chart several methods for deriving useful information solely from motor current, in accord with the teachings of the present invention.
Figure 14:
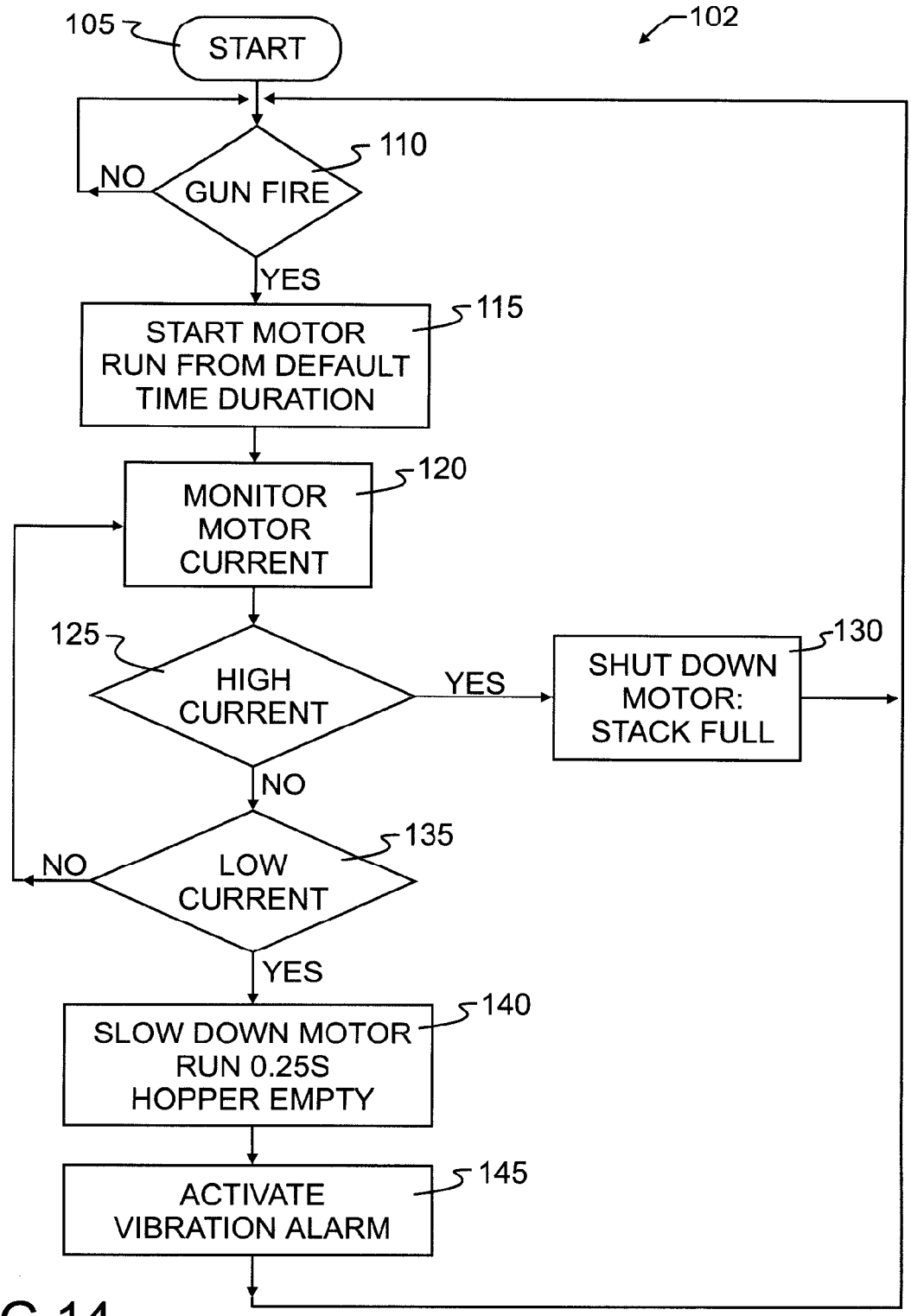
Figure 15:
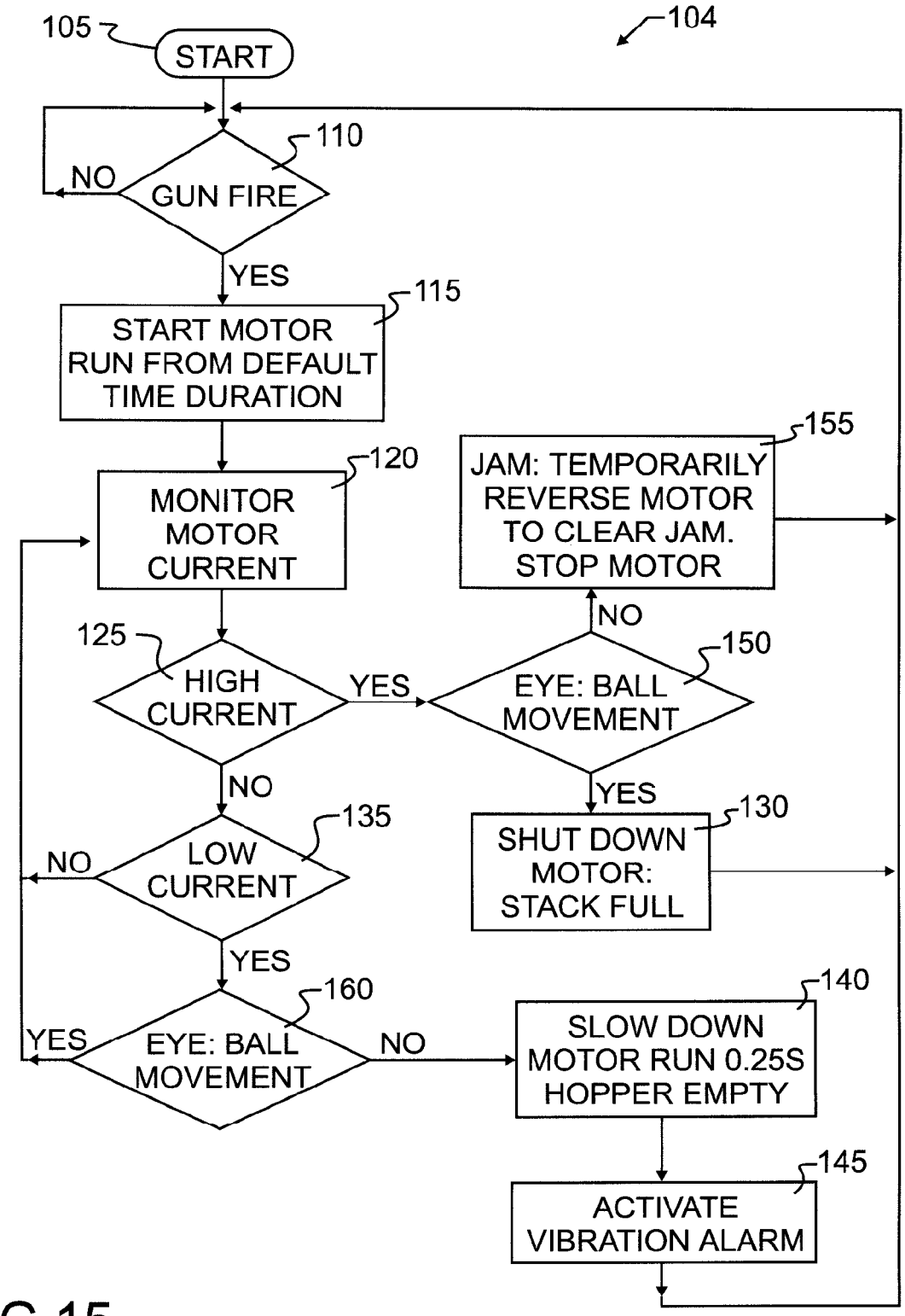

FIGS. 13-15 use flow charts to illustrate several exemplary methods 100-104 in accord with the present invention for deriving useful information solely from motor current. FIG. 13 illustrates a sequence for measuring hopper motor current and detecting either a full stack, a jam, or an empty hopper. According to this method 100, a known technique will be used to detect a gun firing event at step 110 such as described in the patents to the present inventor incorporated by reference herein above. This will trigger the motor to run for some default time duration at step 115. The duration may be infinitesimally short, but more typically will be greater than but approximately equal to the time required for a rapid reload of the ball feed tube 12 or stack. The motor current during this run duration will continuously be compared to a predetermined, known, normal or control value, as shown by step 120. If there is a jam or the stack fills, the motor will be loaded down and will therefore draw higher than normal current as determined at step 125. In such case, the hopper motor will be shut down as shown by step 130. Conversely, if the hopper runs low, there will be a less than normal load on the motor, and the motor will draw less current as determined by step 135. In such case, the motor can be slowed down or even stopped as shown by step 140. In this way, the hopper motor will only be operated for an optimum amount of time necessary to perform the intended reloading.

While FIG. 13 provides no mechanism for alerting the operator, FIG. 14 addresses alerting the operator by activating a vibration or other suitable alarm as shown by step 145, thereby advising the operator that the hopper is running empty. This empty condition, identified by the flow charts of both FIGS. 13 and 14, can readily be remedied by the operator simply by refilling the magazine, thereby reducing unexpected moments where the operator would otherwise be unable to fire. While a vibration alarm is specifically called for in step 145, the present invention contemplates a wide variety of alerting devices and methods. One such preferred apparatus is a separate body-carried or supported device, such as but not limited to a watch, small belt-supported device, pocket apparatus, or other appropriate device. This apparatus may be directly wired to receive an activation signal, but will most preferably be coupled through a short-range wireless communications link.

FIG. 15 combines motor current sensing with optical sensing to further improve operation and control of the hopper. In this method, when high current is sensed flowing through the hopper motor at step 125, an optical or other ball sensor will detect a movement of balls with the loading path, such as at the breech 14 or in the load tube 12, indicating that the load tube 12 or stack is full, or, if there is an absence of ball movement, then this will indicate a jam within the hopper. The checking for movement is important to the present invention, since simple presence or absence detection does not establish or distinguish a jam from a full stack. In other words, if the stack is full there will be balls blocking the eyes. But, depending upon where the jam occurs, in addition to the stack being full there may also be a jam. In those cases where the jam occurs either at the sensor or closer to the breech from the sensor, there will be a ball detected by the sensor. In the prior art, this would be misinterpreted as a full stack. By detecting movement or lack thereof, movement may be discerned. A suitable movement detector would include for exemplary purposes only and not limited thereto the cycling of an off-center optical sensor, cycling of a ball-thickness sensitive sensor, by a wide variety of mechanical contact switches designed to switch at some point of contact with the ball between contact with the ball equator and contact with the ball poles, or other devices that will be apparent to those skilled in the art. A preferred method of sensing might use a larger-than-illustrated optical sensor, such that when a less-than-equatorial portion of the ball were present within the sensing axis, the sensor would indicate the same. Variations in ball diameter at the optical sensing axis would then be detectable.

If high current is detected at step 125 and there are not balls moving through the feed tube 12 or stack as determined at step 150, then the motor will preferably be reversed as shown by step 155 to clear the jam. Other techniques may be used to release the jam, such as secondary devices or vibrations, pulsing of the motor, or any other technique suitable for the particular hopper construction. Whatever technique is determined to be most appropriate for clearing the jam will be implemented. If, instead of higher than normal motor current, lower than normal current is detected as shown by step 135, and if balls are not moving through the feed tube 12 or stack as determined at step 160, then the hopper is empty and the motor can be shut down at step 140 and a vibration alarm or equivalent as described herein above can be triggered at step 145. If lower than normal current is detected at step 135, but balls continue to pass through the stack as determined at step 160, the motor current will continue to be monitored. This condition might, for exemplary purposes, be indicative of a rapid firing sequence. Alternatively, and not illustrated, a minimum threshold may be set which would indicate a sufficiently empty hopper to trigger the vibration alarm, even if the hopper motor is still energized.

Where appropriate, such as when the optical sensors are located in a portion of the gun which may inadvertently be exposed to external light sources, it is contemplated herein to provide optical sensors which utilize unique signatures, such as digital codes formed from pulse position modulation, pulse width modulation, or the like to avoid undesirable triggering due to background light.

In addition to the methods of FIGS. 13-15, the hopper motor can be monitored far more closely, and voltage waveforms or signatures may then be detected. For exemplary purposes only, and not solely limiting thereto, it will be understood that in some hoppers, the motor current will nearly instantaneously reflect various conditions, such as the successful loading of a ball, jams, broken springs, and other success or error conditions. Where sufficient monitoring and comparison or calculating capabilities exist for a reasonable price for a given application, it is expected in accord with the present invention that the waveform will be monitored, and, where appropriate, the operator will be signaled. Once again, the initial signaling will most appropriately be through the aforementioned vibratory alarm, but additional display or indicia may be provided which more specifically indicates a particular error condition.

Other advantage may be attained through the monitoring of hopper motor electrical characteristics. More particularly, by using the motor current or by monitoring the battery voltage one can implement a system where the motor runs long enough to wind a spring in a force feed system, such as may be found in the Christopher et al patents referenced herein above, but stops when the spring is fully wound and the motor cannot continue to move. When the motor has fully wound the spring and can not continue moving, the power to the motor spikes. Stopping the motor at this time saves wasting power and reduces the constant force applied to the paintball after the spring is fully wound. The paintball would only see force from the spring after the motor has stopped.

If the motor is running at full speed when the spring becomes fully wound, normally indicating that the in-feed to the marker breech 14 is filled with paintballs, this can cause a sudden impact that may break paintballs. There is a large momentary impact force that the stack of paintballs must absorb. To improve this situation, the controller board can shut down or even apply a reverse potential to brake the motor just before the spring is fully wound. Following are several exemplary ways to implement this.

A first way uses added mechanical resistance to the motor just prior to the final stall point, where the spring is fully wound and motor torque is directly applied to paintballs. This added resistance will cause the delivered power to the motor to rapidly rise, thereby enabling detection. The added resistance should not cause the motor to stall, but instead be sufficient to detect impending stall. This resistance can be another spring, magnet or some type of flexible arm that adds resistance only when motor has reached a position just prior to the main spring being fully wound. Depending upon the design, and in accord with the present invention, this resistance can act like a shock absorber, so that even if the motor is not shut down when added resistance is applied but continues until the spring is fully wound, the motor is forced into stall condition.

A second way is to monitor the power delivered to the motor and shut down the motor when a selected power level is met. As the spring becomes more tightly wound, the amount of torque required by the motor will increase. The increase in required torque will result in an increase in power delivered to the motor. As power to the motor increases, the current running through the motor will increase and the battery voltage will decrease. These currents or voltages can be monitored, either separately or in combination, and trip points can be used to decide when to shut down the motor. Multiple trip points can be determined so that multiple torque settings can be delivered. The result is that there can be settings that allow the spring to be wound to different levels without entering a motor stall condition. This method would not create any type of sudden force to the paintball. In a worst case situation, the paintball would only be subject to the maximum force from the spring. A given power, controlled using Pulse-Width Modulation (PWM) or other suitable technique, can be applied to the motor causing the spring to be wound to a certain stall point, but if the motor does not shut off there will be additional wasted battery power. Consequently, it is preferable to shut the motor down once the power threshold has been met.

The prior art wound-spring force feed system by Christopher et al operates with a spring pre-wound 90 degrees. The drive cone spring is able to travel from this initial 90 degrees to a fully wound state at 450 degrees, for a total wind range of 360 degrees. Within the granted U.S. Pat. No. 6,889,680 to Christopher et al, the inventors propose using the controller to adjust when the drive mechanism re-winds the spring. Unfortunately, if this teaching is applied, the spring wind and unwind is limited to some amount less than the more desirable 360 degrees of wind. In other words, if the controller is activated at a force greater than the full unwind, the full unwind is never available or achieved. By monitoring maximum force and controlling the winding motor as proposed herein, it is conceived herein to use the multiple force settings referenced herein above that pre-wind the spring to different starting and ending points. Each point may be selected to offer the 360 degrees of rotation, but will use a different amount of pre-wind. As an example, consider a feed system with 3 settings. The first has less pre-winding. This might operate in the range of +5 to 365 degrees, or even from 0 to 360 degrees of wind. The second setting is the standard, operating from 90 to 450 degrees. The third setting would provide more pre-winding, resulting in more spring force, for exemplary purposes operating from 180 to 540 degrees of spring wind. As should be apparent, these settings may be based upon a discrete values desired, as described in the foregoing explanation, or the settings may alternatively be continuously variable, as may be readily designed by those skilled in the art of motor control.

Figure 26:
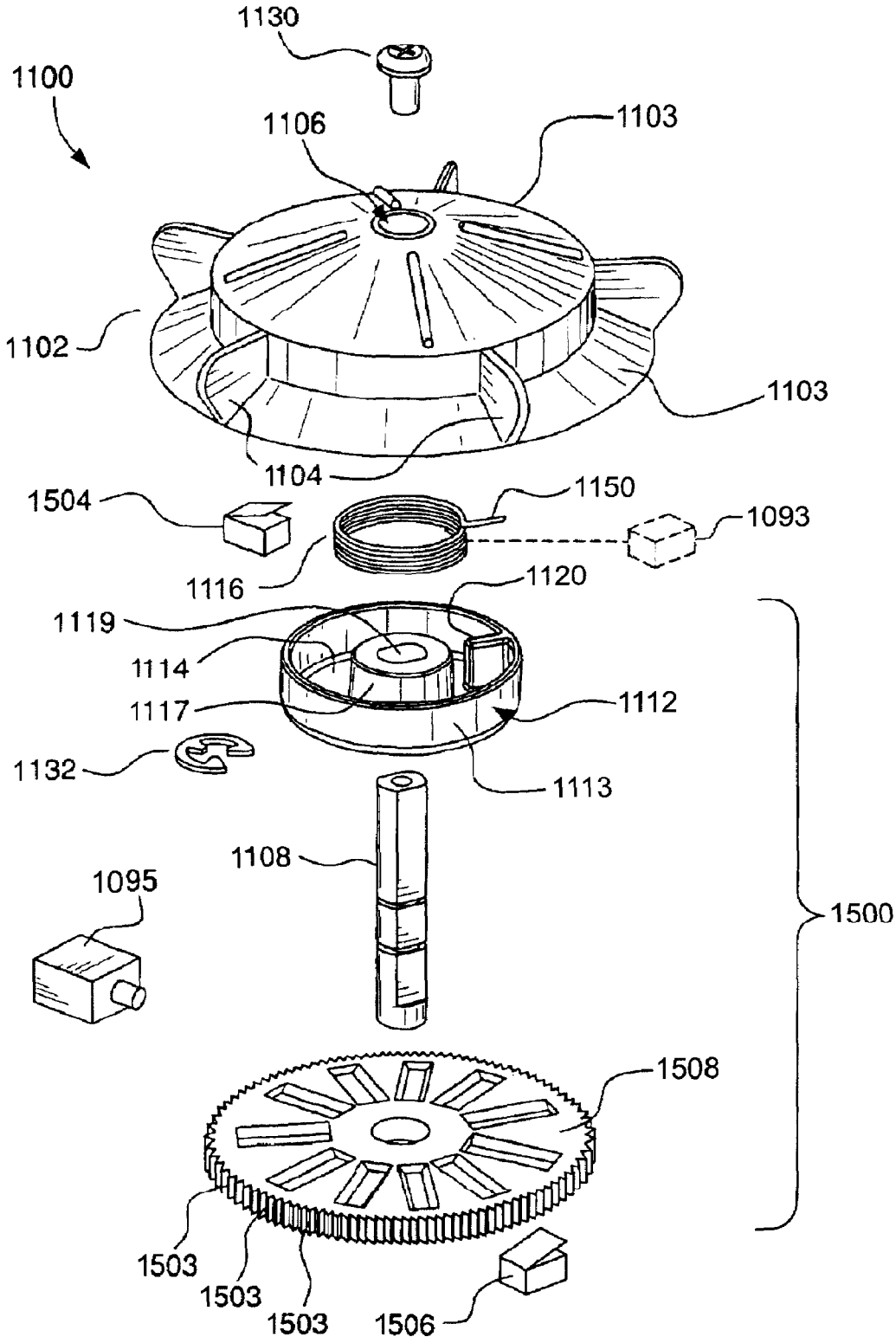
Figure 27:
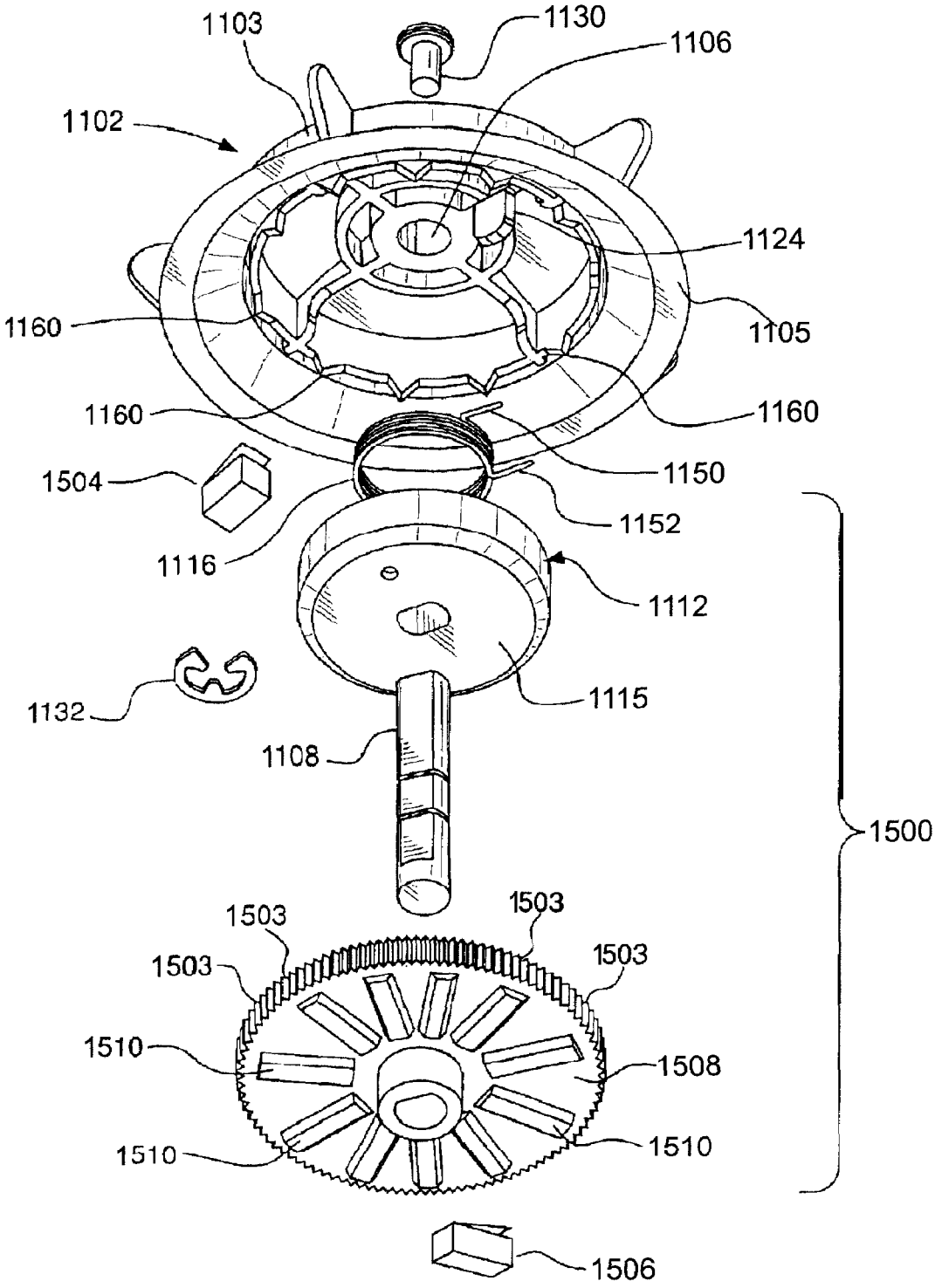
Figure 28:
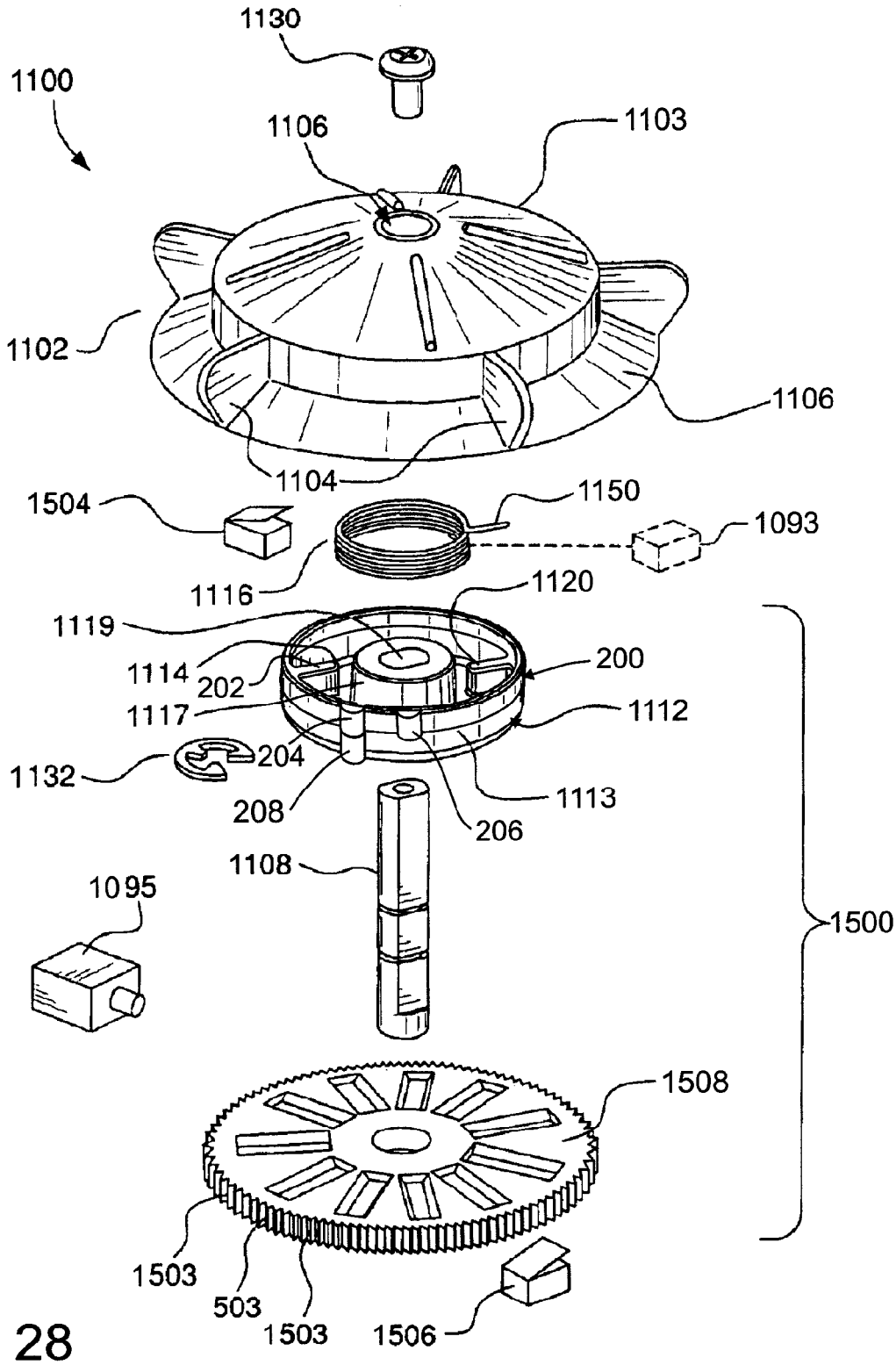
FIG. 28 illustrates a mechanical apparatus that may be used in combination with the loader to achieve a variable spring loading.

FIGS. 26-28 illustrate a mechanical apparatus that may be used in combination with the Christopher et al loader to alternatively achieve this variable spring loading, while still maintaining a full 360 degree wind and unwind. FIGS. 26 and 27 correspond directly to FIGS. 2 and 3 of the Christopher et al U.S. Pat. No. 6,889,680 incorporated by reference herein above. The numbering from the Christopher et al patent has been incremented by 1000, such that, for exemplary purposes, stop 120 of the Christopher et al patent is presently numbered 1120 to avoid any numbering confusion with the remaining figures of the present invention. The Christopher et al patent further provides a full description of each of the parts, to which the reader is referred for brevity in discussing the present invention.

Of particular interest is the combination of spring housing 1112, stop 1120, spring 1116, each which are visible in FIG. 26, and stop 1124 which is visible only in FIG. 27. Spring housing 1112 has a central opening 1119 which is designed to engage with drive shaft 1108 such that when drive shaft 1108 rotates, spring housing 1112 is forced to rotate therewith. In contrast, housing 1103 has a cylindrical opening 1106 which permits housing 1103 to spin relative to drive shaft 1108. However, housing 1103 is not free to endlessly rotate relative to drive shaft 1108 and spring housing 1112. Instead, stop 1124 extends towards spring housing 1112 sufficiently far as to engage with or interfere with stop 1120. Consequently, in operation housing 1103 is free to rotate relative to drive shaft 1108 and spring housing 1112 through just slightly less than 360 degrees. It is common practice to design spring 1116 such that, at the time of assembly, spring leg 1152 engages with stop 1120. Next, stop 1124 will be engaged with spring leg 1150. However, housing 1103 will then need to be rotated relative to spring housing 1112 before moving the two together, such that some spring tension exists from spring leg 1150 tending to drive stop 1124 towards stop 1120. Likewise, there will desirably be an equal and opposite force from spring leg 1152 urging stop 1120 towards stop 1124. This achieves an initial loading, described above, which sets a minimum amount of spring tension that must be overcome to rotate stop 1124 away from stop 1120. The initial rotation in the prior art required between housing 1103 and spring housing 1112, as aforementioned, is 90 degrees.

FIG. 28 illustrates a modification in accord with the present invention which has been made to spring housing 1112 and stop 1120 to permit this initial loading to be mechanically varied. Spring housing 1112 has been reduced in height parallel to shaft 1108, such that stop 1120 will no longer interfere with the rotation of housing 1103 through stop 1124. Depending upon initial design dimensions, stop 1124 may also be reduced in height parallel to shaft 1108, to ensure that there is no interference with stop 1120. Stop 1120 will, however, continue to engage with spring leg 1152 as before.

Into the additional available space, a stop disc 200 will preferably be inserted which is generally cylindrical, but which has a stop 202 protruding radial in therefrom. This stop disc may be rigidly affixed at the time of assembly, through adhesive, ultrasonics or other means, or may alternatively have some type of adjustable means to fix it into position with spring housing 1112. Many such means are known from the fastener art, but for exemplary purposes might include one or more pins, spring-loaded or otherwise, passing between spring housing 1112 and stop disc 200, or additional fasteners external or internal thereto, permanent or temporary adhesives, tapes, or any other suitable means. Preferably, provision will be made for repeated manual adjustment, regardless of the method of coupling.

As but one exemplary method and apparatus, two small external ears 204, 206 are shown protruding slightly from the general cylindrical exterior of stop disc 200. While two are shown, any number may ultimately be provided, from one to many. Adjacent to ear 204 is a similar ear 208 protruding from spring housing 1112. A fastener such as a pin, screw, bolt, ball and detent, or other structure will be provided which will fix ear 208 to ear 204. In this position, and using the prior art method of assembly, housing 1103 will need to be rotated an additional 180 degrees, for a total initial loading of 270 degrees, to engage stop 1124 with stop 202. From this initial point of contact, housing 1103 will still be operative to rotate through a full 360 degrees relative to stop disc 200, thus preserving the operative 360 degree range while varying the initial loading. By providing at least two ears 204, 206, and as many as might be desired, it is possible to enable many different amounts of initial loading through purely mechanical means. As should already be apparent, the use of ears 204-208 is but one exemplary method of coupling and adjustment, and many others will be understood from the fastener and coupling arts.

By providing variable settings, whether mechanically or electrically, when fragile paintballs are being used or when conditions result in more frangible balls, then the operator can use the first setting so that less spring force is applied to the paintball. When hard paintballs are being used, the third setting will permit high firing rates due to the greater force applied to move the paintballs through to the marker.

While many of the aforementioned inventive methods permit sensing through motor current or directly at the magazine, there are other circumstances that may also interfere with ball feed rate which may not be measurable at the magazine. For example, when a paintball inadvertently breaks within the magazine or feed tube 12, it may interfere with or slow the passage of subsequent balls. Since the time between the closing of the beam as bolt 16 returns towards its pre-fire state, as shown in FIG. 3, and the breaking of the beam by a paintball 24 ready to be fired as shown in FIG. 1 is roughly the ball load time, this time interval may also be monitored in accord with the teachings of the present invention. In the event this delay increases above an undesirable threshold, the vibratory alarm may also be triggered by control circuitry as shown in FIG. 6.

Figure 7:
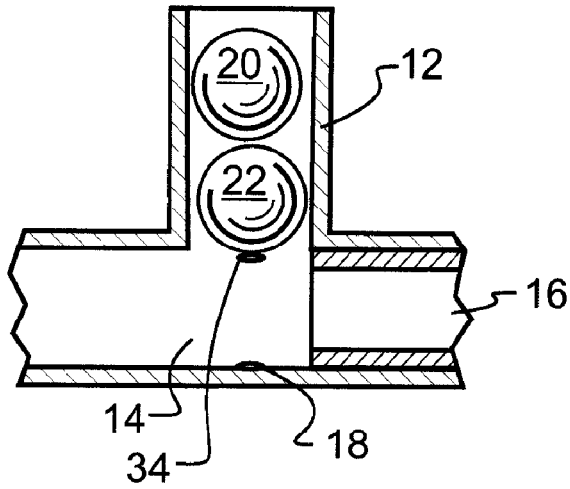
FIG. 7 illustrates a second alternative embodiment sensor arrangement in an empty breech state, just prior to a paint ball dropping into the breech, for use with a second alternative embodiment method, from an enlarged cross-sectional view.
Figure 8:
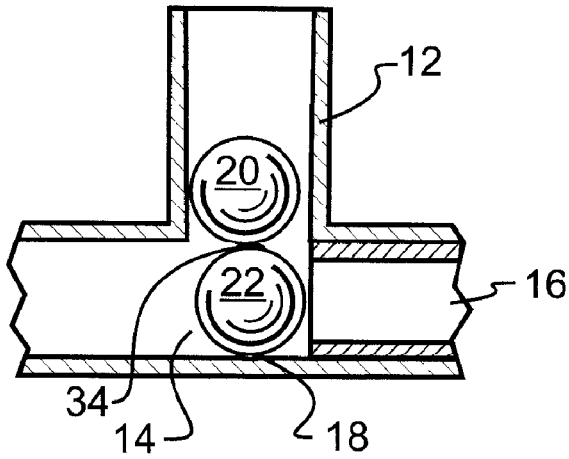
FIG. 8 illustrates the second alternative embodiment sensor arrangement of FIG. 7 in a ready-to-fire position for use with a second alternative embodiment method, from an enlarged cross-sectional view.

Using multiple sensors around the breech 14, with or without the bolt sensor of FIGS. 4 and 5, can also help increase firing rates, while also improving the monitoring of specific time delays. For example, as FIGS. 7 and 8 illustrate, if there is a sensor 34 just above the breech 14 to tell control circuit 40 if there is another ball 20 ready to be loaded and a sensor 18 at the bottom of the breech 14 that tells control circuit 40 when ball 22 is in final position and ready to be shot, then from these sensors the time required for ball 22 to move from feed tube 12 into final position can be precisely determined. As already described herein above, this time can be measure by a micro-controller or the like used as the control circuit 40 in FIG. 6, and used in the firing sequence to calculate solenoid triggering intervals and other gun parameters to speed up the gun operation. This time can be monitored during every shot, and operation adjusted to accommodate changes in real time as the gun is being fired. If the load time changes and becomes excessive, then in addition to varying the solenoid triggering times a warning indicator can also or alternatively be activated as shown in FIG. 6. Excessive load times may be a result of hopper malfunction or empty hopper.

While a vibratory alarm is illustrated therein, those skilled in the art will recognize that other alarms or indicators may be used. A vibratory alarm is preferred in the present invention since it provides silent notification to an operator, thereby avoiding unwanted attention or awareness by a competitor that a problem may exist. Nevertheless, any other indicator which is deemed suitable at the time of design may be incorporated as well. For exemplary purposes only, and not limiting thereto, this indicator can be a buzzer, remote vibrator or buzzer, vibrating motor or other suitable device, and is meant to notify the operator of a possible problem, preferably prior to the problem interfering seriously with the operation of the gun.

Using these same multiple sensors shown in FIGS. 7 and 8, the gun firing rate can be increased, and gun operation can be controlled to compensate for variations in load time that may be caused, for example, by nearly empty magazines or obstacles such as paint or broken paintballs. If there is a sensor 34 just above breech 14 to tell if there is another ball 20 ready to be loaded, and a sensor 18 at the bottom of breech 14 that tells if ball 22 is in final position and ready to be shot, as shown in FIGS. 7 and 8, and with a preset or preferably a history saved of the actual time it takes for balls to move through breech 14 into final position, the solenoid can start to be energized early so that when ball 22 reaches final position bolt 16 will also begin to move immediately. With continued calculation of each interval, the gun will automatically compensate for variations in load time or bolt speeds, regardless of the cause of these variations, and can be operated in an anticipatory mode where the solenoid is energized prior to the ball being in a ready-to-be-fired position.

Figure 9:
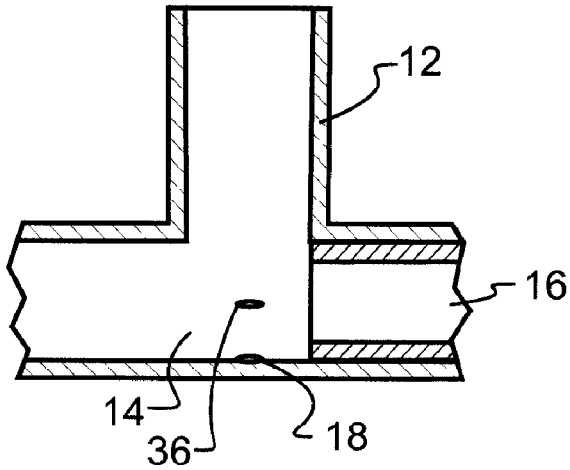
FIG. 9 illustrates a third alternative embodiment dual sensor arrangement in a ready-to-fire position for use with an alternative embodiment method, but with the breech empty, from an enlarged cross-sectional view.
Figure 10:
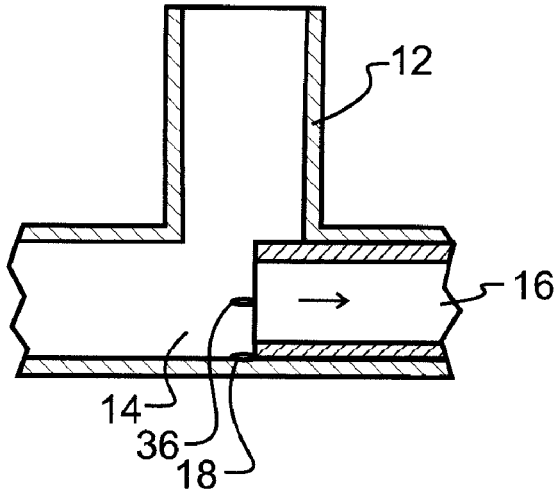
FIG. 10 illustrates the third alternative embodiment sensor arrangement of FIG. 9 during firing, with the bolt located in a half-way forward position, which would ordinarily be just subsequent to contact with a paintball within the breech, from an enlarged cross-sectional view, and without a paintball in the breech.
Figure 11:
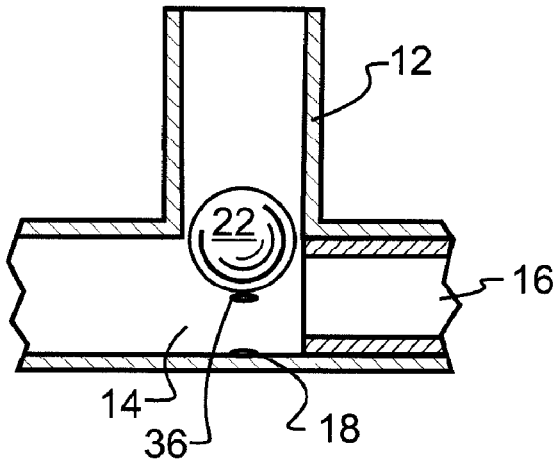
FIG. 11 illustrates the third alternative embodiment sensor arrangement of FIG. 9 just subsequent to firing, with the bolt located in a ready-to-fire position, and with a paintball passing into the breech, from an enlarged cross-sectional view.

A third alternative embodiment dual sensor configuration is illustrated in FIGS. 9-11. This third alternative embodiment is very similar to the second alternative embodiment shown in FIGS. 7 and 8, and provides for anticipatory action where the solenoid is energized prior to the ball being in a ready-to-be-fired position. However, in this embodiment, top feed sensor 36 is located not at the top of bolt 16, but at the diametric center of bolt 16, or roughly centered on a ball 22 loaded in breech 14 in a ready to fire position. The use of two breech sensors can achieve all of the benefits of a three sensor configuration, where the three sensor configuration includes both bolt sensor 32 of FIGS. 4 and 5 and the two breech sensors 18, 34 of FIGS. 7 and 8, if an assumption holds true. This assumption is that the solenoid valve operation dominates bolt lag time. For example, it may take 15 milliseconds for bolt 16 to move from rest to the center of breech 14, as an example. In this case, 13 milliseconds are required for bolt 16 to start moving, and only 2 milliseconds for bolt 16, once moving, to continue to the center of breech 14. In such case, using a third sensor to determine the exact time bolt 16 begins to move may be unneeded, as it only accounts for 2 milliseconds difference in time.

Figure 12:
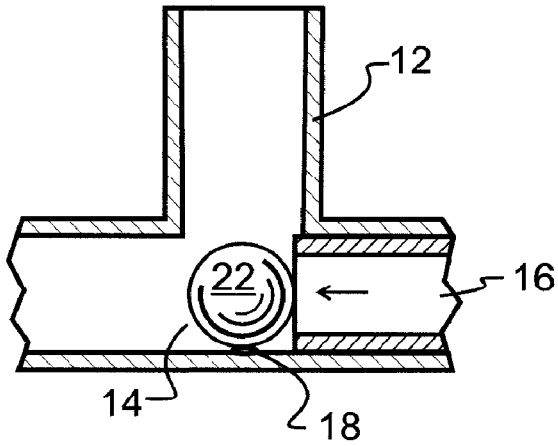
FIG. 12 illustrates the third alternative embodiment dual sensor arrangement of FIG. 9 in a ready-to-fire position, from an enlarged cross-sectional view.

In addition to no longer requiring the third sensor, additional advantage is obtained by moving the second sensor down from the position shown in FIG. 7. First, when bolt 16 retracts to roughly the position shown in FIG. 10, but after firing so that bolt 16 is moving to the right, sensors 18, 36 will be unblocked. Since the rate of travel of bolt 16 in this direction is typically very high, the time required for bolt 16 to return to the position of FIG. 9 after sensors 18, 36 are cleared is very small, and may be ignored. Consequently, the interval from the clearing of sensors 18, 36 to ball 22 dropping into the position illustrated in FIG. 11, where the top sensor 36 beam is broken, is a statistically accurate measure of the actual rate of travel (speed) of ball 22 into breech 14. Further, this beam being broken signifies the presence of a ball 22 which will soon be in a ready position. With the speed readily calculated, the time required for ball 22 to complete the passage will also be readily determined. Consequently, the time before reaching the ready-to-fire state, where ball 22 is properly positioned in breech 14 as illustrated in FIG. 12, may be anticipated with great reliability, and the certainty that ball 22 will reach the intended position is also very high.

For the purposes of the present disclosure, the time difference from bolt 16 opening the beams to ball 22 breaking the top beam will be called start load time. For the purposes of the present disclosure, the final load time will be understood to be the time between ball 22 breaking the top beam and ball 22 reaching the loaded position within breech 14. The total load time will be understood to be the sum of the start and final load times. These times also serves as an indicator for whether the hopper being used is force-fed or gravity feed. Force-feeding a ball 22 will result in a small time and time difference from one load to the next. A gravity feed hopper will have much larger and more unpredictable time differences. This is because factors such as tilt of the hopper, inertial forces brought about by movements of the gun such as during operator movement, and other such factors may alter the time greatly. If a gravity feed hopper is detected, based upon the aforementioned large load time, then pre-energizing the solenoid is ruled out due to inconsistent and unpredictable load times. If a force-feeding hopper is detected, then the solenoid can be pre-energized with great certainty. Also note that bolt movement is very fast, once the bolt is in motion as discussed herein above, so the majority of the time required for ball 22 to drop is dominated by the speed at which ball 22 travels towards breech 14, once bolt 16 has cleared the way. This timing will also give good estimates of needed time required for ball 22 to move to bottom of breech 14.

When the force-fed hopper is not detected, or when a hopper exhibits a reduced feed rate, an additional control method may desirably be implemented which limits the likelihood of chopping. In some loaders the present inventor has identified the existence of "bounce" in a near-empty loader. While not wishing to be bound by any theory, this phenomenon is believed to arise from the tendency of balls to be thrown unpredictably about in a near-empty magazine. When the feed stack is empty, the few remaining balls may be thrown erratically about, including down into the empty feed tube. In such instance, the ball will trigger either of motion or presence sensors, and the bolt may be activated responsive thereto. The problem is that in such instance, the ball may bounce off of the breech partially back into the feed tube. Furthermore, without the existence of forces or weight from a full feed stack, even abrupt movement of the gun may jar a single ball partially out of the breech. If the bolt is moving into contact with the ball when the ball has either bounced or been jarred from the breech, the ball will be chopped. To reduce the likelihood of this resulting in undesirable chopping, an additional step and delay may be initiated, once a determination has been made that there is a likelihood of a nearly empty loader. The step is one of confirming that the ball has firmly reached and stayed at the bottom of the breech for some reasonable time period. For exemplary purposes, an additional 15 millisecond delay followed by a re-check of the ball position would reveal many instances of "bounce" and avoid the undesirable chopping that would otherwise be associated therewith. This extra control method would, of course, most preferably only be initiated when a nearly empty loader condition was detected. If, at a later time and for any reason, detection or computation desired by a designer, it was determined that the loader was no longer in this nearly empty state, the extra control method would most preferably then be deactivated, thereby allowing the gun to return to full operational speeds enabled by the present invention. This might, for exemplary purposes only, occur after several shots were fired and force-feed timing was detected for each of those sequential shots.

The start load time can be stored and associated with final position timing from previous shots. For exemplary purposes only, an 8 millisecond starting load time may consistently result in a 7 millisecond final load time. A 14 milliseconds starting load time may consistently result in a 12 millisecond final load time. An historical look-up table can be generated within the circuit controller of FIG. 6 as the marker if fired, by associating start load times to final load times.

Example 1

Measured Time Intervals

Abort time=4 mS

Start Load Time=8 milliseconds. This indicates a force hopper feed, and the ball in middle breech is detected. Timing consistent with previous shots.

Final Load Time=7 milliseconds (Measured from previous shot)=Expected time for ball to cross from first sensor 36 until crossing bottom sensor 18. Bolt lag=13 milliseconds=Measured 15 milliseconds but we know that usually 2 milliseconds less for bolt 16 to begin moving.

Aggressive approach: History shows load times of 7 milliseconds and current timing thus far shows force-feeding with consistent load timing. Start pre-energizing solenoid at time ball reaches middle sensor 36. At about 7 milliseconds (if consistent with last shot), the ball will reach bottom sensor 18 and 6 milliseconds later bolt 16 will start moving forward. So there would about 6 milliseconds extra load time, if needed.

Safe approach: Since abort time is 4 milliseconds, start pre-energizing solenoid 2 milliseconds before expected time ball will reach bottom sensor 18. Abort shot if actual load time is 2 milliseconds greater than expected.

Example 2

Using a Look Up Table within the Circuit Controller

Measured Time Intervals:

Abort time=4 milliseconds

Start Load Time=13 milliseconds=Force-feed hopper detected and ball in middle breech detected. Timing not consistent with previous shot.

Final Load Time=Expected time for ball to cross first sensor 36 until crossing bottom sensor 18. Since start load time is inconsistent, can't use last final load time. Must use expected final load time from historical look-up tables. In the past, from the look-up tables, 13 milliseconds start load time may lead to a 20 millisecond final load time.

Bolt lag=13 milliseconds=Measured 15 milliseconds but we know that usually 2 milliseconds less for bolt 16 to begin moving.

Aggressive approach: History shows start load times of 13 milliseconds leads to 20 milliseconds final load times and current timing thus far showing force-feeding. Start pre-energizing solenoid 9 milliseconds after ball reaches middle sensor 36. In another 11 milliseconds (if consistent with history), ball will reach the bottom sensor 18 and 2 milliseconds later bolt 16 will start moving forward. So there would be about 2 milliseconds of extra load time, if needed.

Safe approach: Wait until ball reaches bottom sensor 18 to start solenoid.

Additional very beneficial information may be gleaned or calculated through a monitoring of load times. Most preferably, paintball load times can be monitored shot by shot. Excessive load times may be a result of either hopper malfunction or an empty hopper. In the case of a standard force feed hopper running empty, the last approximately eight balls (depending on loader type) will not be force-fed. These balls will rely on gravity to load into the marker. The load times will increase significantly. For exemplary purposes, we will say to about 50 mS, though it will be understood that the actual load times will vary depending upon the marker, magazine, and feed system. When the load time increases, the alarm can be activated to notify the user of the soon-to-be-empty hopper. If on subsequent shots the load times go back to sub 25 mS, this indicates that the hopper was refilled with paintballs and became force-fed again, or there was a temporary hopper malfunction that resolved itself.

Simple algorithms can be used to help distinguish between empty hopper and hopper malfunction loading times. If only one load time becomes excessive, but later load times are within the force-feed range, than this usually would be a one-time hopper malfunction. If multiple load times are excessive, than this would most likely indicate a soon-to-be-empty hopper, or a hopper that otherwise will require servicing or attention from the operator. Further, if multiple load times are excessive and then multiple load times are within the force-feed range that this would usually mean that the hopper was refilled with paintballs. If multiple load times are excessive and are followed by a single good load time, but then the times revert back to excessive load times this usually does not mean the hopper was refilled with paintballs. Repetitive variations between short and long load times might also trigger an indication of a need for inspection, cleaning or servicing of the mechanical loader components, since these variations might be a result of obstacles, broken balls, paint, failing components, and the like.

To further enhance the operation of the marker and magazine, and provide the operator warning of impending servicing needs, a counter may be provided to count down and give a warning alarm at a selectable setting such as for exemplary purposes when only 25 of an original 150 balls remain. In this case, the warning alarm would activate when the hopper has about 25 paintballs left, meaning after shooting 125 paintballs. This counter could be reset when the hopper is refilled and load times change from excessive to within the force-feed range as described above. Also, other means may be provided to reset the counter, such as a reset button or from pulling the trigger and holding for a predetermined time interval. The warning alarm may preferably be further provided with a different signature than the malfunction/empty alarm so the user can tell the difference.

The measurement of load times may be achieved in the paintball marker by way of sensors monitoring the paintball entering the marker's breach, or by measuring the hopper's motor current and the resulting signatures. Motor current may then be used to identify to control circuit 40 what the motor load is, and timing the different motor loads can provide the same information.

Following are several examples to better illustrate the foregoing.

Example 3

1. Hopper is full, 150 paintball capacity, and counter is at 150 after turning on marker for a game.
2. 125 paintballs are shot and warning alarm goes off. 25 balls left in hopper.
3. User then refills hopper and resets counter by pressing button (or holding trigger)
4. Hopper is full, 150 paintballs and counter is at 150.

Example 4

1. Hopper is full, 150 paintballs and counter is at 150 after turning on marker for a game
2. 125 paintballs are shot and warning alarm goes off. 25 balls left in hopper.
3. User ignores alarm and shoots 17 more balls.
4. Empty hopper alarm goes off when down to 8 balls.
5. User then refills hopper.
6. Next 2 shots are force feed and counter is automatically reset.
7. Hopper is full, 148 paintballs and counter is at 148.

Example 5

1. Hopper is not full, 100 paintballs and counter is at 150 after turning on marker for a game.
2. 92 paintballs are shot and empty hopper alarm goes off. 8 balls left in hopper and counter is down to 58.
3. User then refills hopper.
4. Next two shots are force-fed and counter is automatically reset.
5. Hopper is full, 148 paintballs and counter is at 148.

Example 6

1. Hopper is full, 150 paintballs and counter is at 150 after turning on marker for a game.
2. 100 paintballs are shot. 50 balls left in hopper.
3. User refills hopper.
4. 150 balls in hopper. Counter thinks there are 50 balls left in hopper.
5. User resets counter by pressing button (or holding trigger).
6. 150 balls in hopper. Counter reset to 150.

Example 7

This is an example of a break in the system.

1. Hopper is full 150 paintballs and counter is at 150 after turning on marker for a game.
2. 100 paintballs are shot. 50 balls left in hopper.
3. User refills hopper.
4. 150 balls in hopper. Counter thinks there are 50 balls left in hopper.
5. 25 balls are shot so 125 balls in hopper, counter thinks there are 25 balls left and warning alarm goes off.

This break in the system could have been solved by the user manually resetting the counter or by adding another type of sensor. Either a sensor that roughly monitors the amount of paintballs in a hopper or a sensor that detects each time the hopper lid is opened and closed.

The sensor that monitors the amount of paintballs could be achieved in a number of ways, but a simple optical sensor may be used to detect if there are more than 25 balls. Since the warning alarm in this example will go off when counter gets down to 25 balls, the optical sensor can be used to double check whether the hopper has more than 25 balls. A very rough measurement will work. The optical sensor might then be a break beam or reflective sensor, as two examples of the many techniques which might be used in accord with the present teachings.

The sensor that detects lid opening and closing can be a simple tact switch, a magnet used with a Hall effect sensor, or a magnet with a reed relay. The magnet may be easier to use because the magnet can be built into the lid and the sensor can be mounted on the circuit board. When the lid swings open or closed, the sensor will either detect the magnet presence or not. This type of sensor will notify that the counter should be reset because the hopper lid was opened and closed.

Figure 16:
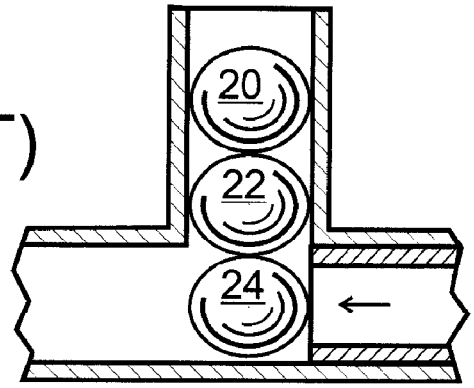
FIG. 16 (PRIOR ART)
FIGS. 16-18 illustrate a prior art firing sequence, demonstrating one cause of undesirable chopping.
Figure 17:
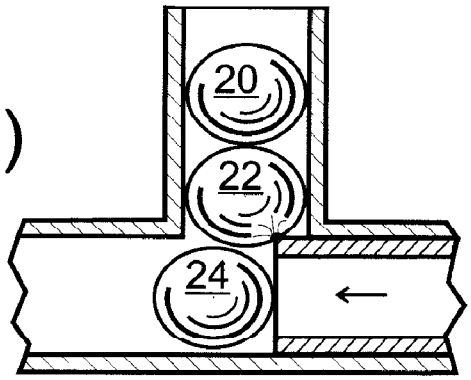
FIG. 17 (PRIOR ART)
Figure 18:
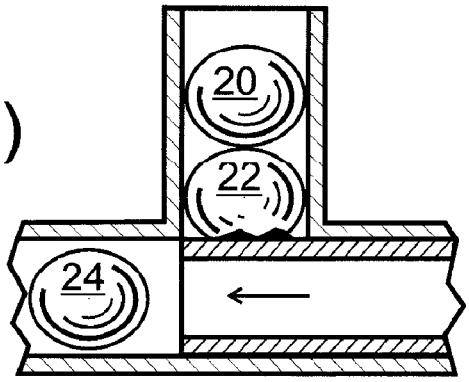
FIG. 18 (PRIOR ART)

The foregoing descriptions generally discuss the use of either optical detection or motor sensing. However, these separate and independent techniques may further be combined for additional novel benefit and advantage. FIGS. 16-18 illustrate a problem with prior art high-speed force feed systems. As shown therein, in order to increase feed rates there is commonly a greater force applied to the stack of paintballs. Unfortunately, when the force is applied to the stack, each paintball within the stack will be compressed and may deform as shown in FIG. 16. Unfortunately, the balls remain compressed when bolt 16 begins forward travel, as shown in FIG. 17. This leads to undesirable interference between bolt 16 and ball 22. This interference may result in undesirable chopping, not of ball 24 in breech 14, but of the next or second ball 22 in the stack. The same effect will occur with small paintballs, due to the size allowing a second ball to partially enter the breech 14 at lower compressive forces.

Figure 19:
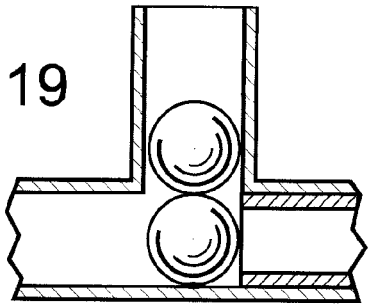
FIGS. 19-25 illustrate a preferred embodiment motor control sequence which reduces the prior art chopping of FIGS. 16-18.
Figure 20:
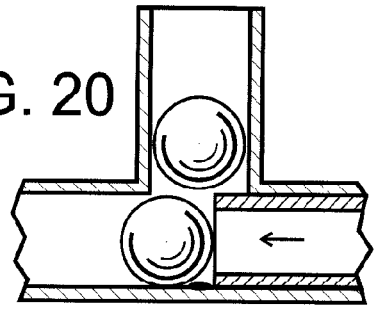
Figure 21:
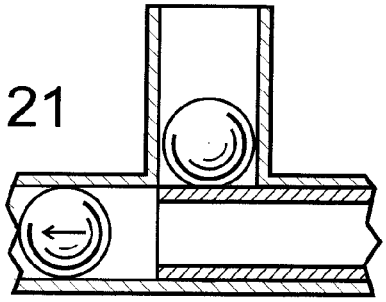
Figure 22:
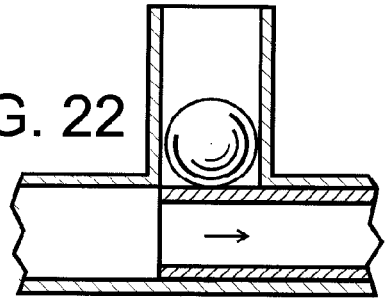
Figure 23:
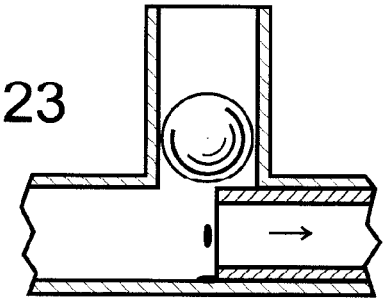

To avoid this undesirable chopping, FIGS. 19-25 illustrate a combination of motor control and optical sensing. As shown therein, the hopper, magazine or loader motor is controlled such that consequential forces are only applied during the interval of time when the balls must be moved. No unnecessary forces are applied either before or subsequent in a given shot firing. Most desirably, the forces will for the most part only be sufficient to avoid accidental emptying of the feed tube 12. Consequently, as shown in FIG. 19, the balls retain their original geometry, and are not deformed. As a result, as shown by FIGS. 20 and 21, the ball is fired without any risk of chopping. Even at FIG. 22, it is still preferable not to apply any undesirable force, since extra force at this time will undesirably add friction between the ball and bolt 16, which may result in slower bolt speeds and may also undesirably damage or weaken the ball. Once bolt 16 has passed the half-way point as shown in FIG. 23, control circuit 40 will receive an indication of the same by the indication from sensors 18, 36. In response thereto, control circuit 40 will most preferably communicate with the loader and responsive thereto initiate the motor to increase force from the loader. The actual increase of force will most desirably be approximately simultaneous with bolt 16 clearing the feed tube. Consequently, the communication will for the purposes of the present disclosure be considered to be desirably temporally approximately simultaneous with bolt 16 clearing the feed tube, with the understanding that, dependent upon a desired design, component characteristics and control logic, motor initiation may occur such that forces begin to build at any time between FIGS. 21 and 24. The more the force increases in similar to an impulse function, and the more closely in time to the bolt position illustrated in FIG. 24, the more desirable.

Figure 24:
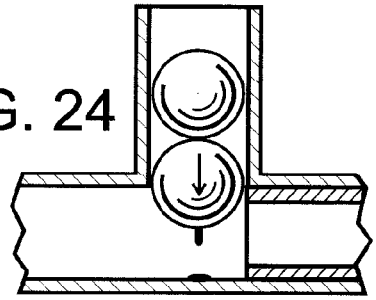
Figure 25:
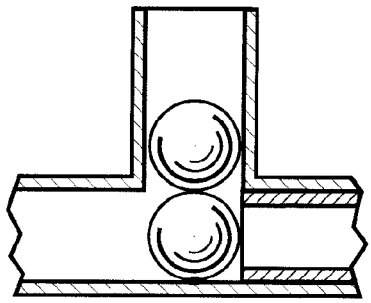

As the motor force increases, bolt 16 will finish retracting, and the ball will be driven into breech 14 under the full force available from the loader as illustrated in FIG. 24. If there is a spike in the motor current during this period, this is indicative of a jam. However, when the ball reaches the position shown in FIG. 24, this will again most preferably be communicated to the loader, and the loader motor may be stopped or slowed in anticipation of the ball reaching the ready position in the breach. If the motor is continued to be driven, the motor current will be monitored such that the motor may be stopped or even reversed once the ball has reached the final ready-to-fire position illustrated by FIG. 25. In the case of small diameter paint balls, reversing the motor may additionally allow the second ball in the stack to be raised vertically with more ease by the traveling bolt, by reducing forces applied to the feed stack. This in turn allows the second ball to be returned properly to a position above the bolt and fully within the feed stack with less chance of the type of chopping illustrated in FIGS. 16-18. This sequence thereby maintains loading time at an absolute minimum without deforming the balls during firing, and more gently transports the balls by not slamming them into either the bolt in FIG. 22 or the breech as the ball approaches the ready-to-fire position shown in FIG. 25.

Using the present teachings, the motor may be driven to simulate and replace, or more preferably improve upon, the operation of the spring-modulated force feed systems of Christopher et al and the like referenced herein above. As may be apparent after reviewing FIGS. 19-25, the motor and spring operate as a combined pair, capable of individually or jointly applying forces to the paintballs. By controlling the motor drive responsive to the optical sensing of ball position as shown in FIGS. 19-25, it is possible to provide both rapid ball movement and soft placement of the balls without the undesirable ball compression shown in prior art FIGS. 16-18. Furthermore, the amount of motor force and spring force may each be varied independently of the other to optimize operation of a particular marker and magazine. In order to control the motor using breech paintball position information, there must be a limited degree of communication between the hopper and marker. The mode of communication is irrelevant, and may involve many diverse technologies including wired communications lines, radio links, or any of a very diverse set of known techniques. Regardless of communications link, the information which must be exchanged depends upon the source.

Gun Sends Hopper the following information:

1. Indication when gun is fired. Hopper can then start motor.

2. Indication when ball is ½ loaded into breech 14. Hopper can stop motor, slow motor and/or monitor motor current.

3. Indication when ball is fully loaded into breech 14. Hopper can stop motor, slow motor and/or monitor motor current.

4. Indication of long paintball loading times. If vibrating alarm is mounted in hopper, hopper will activate alarm to notify user. May be based on load time information and hopper sensors.

Hopper sends Gun the following information:

1. If vibrating alarm is mounted in gun: Empty hopper notification: Less than 20 balls. Gun can give warning to user of low ball levels.

In summary then, some of the additional capabilities enabled by motor power detection include:

1. Shutting down the motor upon entering a stalled motor condition;

2. Using a shock absorber to lessen the impact of the motor on paintballs when reaching stall condition, and then subsequently shutting down the motor to save power;

3. Using a shock absorber or other added resistance to make trip power detection easier, so that the motor is shut down prior to reaching a stall condition;

4. Reducing the motor force after the feed stack is filled, to reduce chopping or otherwise damaging the second ball in a stack;

5. Using power detection trip points to shut down the motor at selectable levels and pre-loads of spring winding. The spring could, for exemplary purposes, be wound to 90% or to 50%; and 6. Using operator selectable spring force settings, which might be associated with different power detection trip points, to give desired operation.

As should now be apparent, there are a number of control systems and methods presented herein, each which optimize the operation of an electronically controlled paint ball delivery and firing system, thereby facilitating operation reliably at enormous rates, and which in some cases may further provide early warning of impending need for service.

While the foregoing details what is felt to be the preferred and additional alternative embodiments of the invention, no material limitations to the scope of the claimed invention are intended. The variants that would be possible from a reading of the present disclosure are too many in number for individual listings herein, though they are understood to be included in the present invention. As but one example, the features and methods which are described with respect to any one of the foregoing preferred and alternative embodiments are contemplated for all embodiments and variants thereof, unless functionally or otherwise inappropriate. Further, features and design alternatives that would be obvious to one of ordinary skill in the art are considered to be incorporated also. The scope of the invention is set forth and particularly described in the claims herein below.

I claim:

1. A method of anticipatory operation of a bolt in an electro-pneumatic paint ball gun to improve a firing rate of said gun, comprising the steps of:

measuring a rate of ingress with respect to time of paint balls into a breech in said paint ball gun;

monitoring for an electrical activation associated with initiating forward bolt motion;

measuring a forward motion time interval primarily comprised by the time required to begin to move said bolt forward from said electrical activation; and triggering said bolt through an electrical activation prior to a paint ball being in a ready-to-fire position in said breech, responsive to said bolt forward motion time interval.

2. The method of anticipatory operation of a bolt in an electro-pneumatic paint ball gun to improve a firing rate of said gun of claim 1, further comprising the step of discerning a position of a ball relative to said firing position.

3. The method of anticipatory operation of a bolt in an electro-pneumatic paint ball gun to improve a firing rate of said gun of claim 2, wherein said step of discerning a position of a ball relative to said firing position further comprises the step of detecting ball presence in at least two different locations from said firing position.

4. The method of anticipatory operation of a bolt in an electro-pneumatic paint ball gun to improve a firing rate of said gun of claim 3, wherein said step of detecting ball presence in at least two different locations from said firing position further comprises the step of sensing a characteristic of an optical beam.

5. The method of anticipatory operation of a bolt in an electro-pneumatic paint ball gun to improve a firing rate of said gun of claim 3, further comprising the steps of:

calculating an interval of time between a ball being detected in said detecting ball presence step at a first one of said locations and being detected in said detecting ball presence step at a second one of said locations; and advancing said triggering of said bolt based upon detecting a firing ball in said detecting ball presence step at said first one of said locations by an amount which causes said bolt to move immediately when said firing ball is detected in said detecting ball presence step at said second one of said locations.

6. The method of anticipatory operation of a bolt in an electro-pneumatic paint ball gun to improve a firing rate of said gun of claim 1, further comprising the step of discerning an instantaneous bolt position.

7. The method of anticipatory operation of a bolt in an electro-pneumatic paint ball gun to improve a firing rate of said gun of claim 1, further comprising the steps of:

storing comparative ingress of paint ball data; and triggering said bolt responsive to said stored ingress of paint ball data.

8. The method of anticipatory operation of a bolt in an electro-pneumatic paint ball gun to improve a firing rate of said gun of claim 2, further comprising the steps of:

storing comparative ingress of paint ball data; and triggering said bolt responsive to said stored ingress of paint ball data.

9. The method of anticipatory operation of a bolt in an electro-pneumatic paint ball gun to improve a firing rate of said gun of claim 1, wherein said step of measuring a rate of ingress further comprises the steps of:

detecting a retreat of said bolt;

sensing passage of a paint ball partially but not entirely into said breech; and calculating said rate of ingress from said detecting and sensing steps;

and further comprising the step of:

advancing said triggering of said bolt based upon said calculating step by an amount which causes said bolt to move immediately when said paint ball reaches a ready to fire position within said breech.

10. A method of anticipatory operation of a bolt in an electro-pneumatic paint ball gun to improve a firing rate of said gun, comprising the steps of:

discerning a position of a ball relative to a firing position by detecting ball presence in at least two different locations from said firing position;

calculating an interval of time between a ball being detected in said detecting ball presence step at a first one of said locations and being detected in said detecting ball presence step at a second one of said locations;

measuring a rate of ingress of paint balls into a breech in said paint ball gun;

monitoring for an electrical activation associated with initiating bolt motion;

measuring a time interval required to move said bolt from said electrical activation;

triggering said bolt through an electrical activation prior to a paint ball being in said firing position in said breech responsive to said bolt movement time interval, by advancing said triggering of said bolt based upon detecting a firing ball in said detecting ball presence step at said first one of said locations by an amount which causes said bolt to move immediately when said firing ball is detected in said detecting ball presence step at said second one of said locations.

* * * * *